US006490832B1

(12) United States Patent
Fischbach et al.

(10) Patent No.: US 6,490,832 B1
(45) Date of Patent: Dec. 10, 2002

(54) SLIDING DOOR SYSTEM

(75) Inventors: Stefan Fischbach, Leonberg (DE); Josef Fuechtmann, Beverungen (DE); Heinz Luithlen, Rutesheim (DE); Karl Mettenleiter, Weil der Stadt (DE)

(73) Assignee: GEZE GmbH & Co., Leonberg (DE)

( * ) Notice: Subject to any disclaimer, the term of this patent is extended or adjusted under 35 U.S.C. 154(b) by 0 days.

(21) Appl. No.: 09/142,090

(22) PCT Filed: Feb. 28, 1997

(86) PCT No.: PCT/EP97/01014

§ 371 (c)(1),
(2), (4) Date: Dec. 22, 1998

(87) PCT Pub. No.: WO97/32103

PCT Pub. Date: Sep. 4, 1997

(30) Foreign Application Priority Data

| | | |
|---|---|---|
| Mar. 1, 1996 | (DE) | 196 07 891 |
| Jul. 16, 1996 | (DE) | 196 28 673 |
| Jul. 16, 1996 | (DE) | 196 28 670 |
| Dec. 3, 1996 | (DE) | 196 50 132 |
| Dec. 4, 1996 | (DE) | 196 50 351 |
| Dec. 27, 1996 | (DE) | 196 54 476 |
| Dec. 27, 1996 | (DE) | 196 54 477 |
| Dec. 27, 1996 | (DE) | 196 54 478 |
| Jan. 13, 1997 | (DE) | 197 00 831 |
| Jul. 16, 1999 | (DE) | 196 28 657 |

(51) Int. Cl.[7] ..... E06B 1/04
(52) U.S. Cl. ..... 52/207; 49/360
(58) Field of Search ..... 52/207, 238.1, 52/243.1; 49/360, 118, 116, 123, 147, 148

(56) References Cited

U.S. PATENT DOCUMENTS

| | | | | |
|---|---|---|---|---|
| 3,834,081 A | * | 9/1974 | Catlett | 49/360 |
| 3,872,622 A | * | 3/1975 | Berk | 49/360 X |
| 4,050,191 A | * | 9/1977 | Azuma | 49/123 X |
| 4,401,033 A | | 8/1983 | Gerken | 104/94 |
| 4,424,605 A | | 1/1984 | Squires et al. | |
| 4,475,312 A | | 10/1984 | Deutschle | 49/360 |
| 5,634,297 A | * | 6/1997 | Ito | 49/360 |

FOREIGN PATENT DOCUMENTS

| | | | |
|---|---|---|---|
| AU | 543048 | 3/1985 | |
| DE | 19 34 505 | 1/1966 | |
| DE | 2336310 | * 2/1975 | 49/123 |
| DE | 35 13 591 | 10/1986 | |
| DE | 36 02 567 | 7/1987 | |
| DE | 38 23 188 | 1/1990 | |
| DE | 90 11 421 | 11/1990 | |
| DE | 9302490 | 6/1993 | |
| DE | 44 00 940 | 4/1995 | |
| EP | 0 066 658 | 12/1982 | |
| EP | 0 620 353 | 10/1994 | |
| FR | 2 102 924 | 7/1972 | |
| FR | 2 136 842 | 12/1972 | |
| GB | 1104057 | 2/1968 | |
| GB | 2 201 192 | 8/1988 | |

* cited by examiner

*Primary Examiner*—Jerry Redman
(74) *Attorney, Agent, or Firm*—Crowell & Moring LLP

(57) ABSTRACT

A sliding door system is provided which has a support frame including vertical posts and a horizontal transom. An assembly supporting a sliding door wing is supported at the support frame and includes a running mechanism operable to carry the door wing disposed in a running mechanism housing. A drive motor assembly disposed in a drive motor assembly housing is operably connected to the running mechanism to move the door wing. The running mechanism housing and the drive motor assembly housing are disposed one behind the other in a direction transverse to the transom and door wing and are configured and dimensioned to form a parallelepiped with a vertical height fitting within a vertical height of the transom.

41 Claims, 15 Drawing Sheets

SLIDING DOOR SYSTEM

BACKGROUND AND SUMMARY OF THE INVENTION

The invention relates to a sliding door system with at least one motor drive sliding door wing, and comprising a running mechanism with a drive motor, control devices, circulating drive belt guided over deflection rollers, drivers for the connection of the drive belt and wing, a latching system, and motion sensors and the like.

Known door drives, such as, for example, the automatic sliding door drive described in DE-OS 36 02 567, are put together from a plurality of components, such as electrical motor, electronic control unit, carrier with running mechanism, latching device etc. The individual components are arranged alongside one another on a spatially fixed horizontal beam. The arrangement takes place essentially in a common vertical plane in the vicinity of the beam. Thus, a relatively large constructional height results. Furthermore, the cost of installation is mainly relatively high, because the individual components must each be arranged individually on the carrier via their own mounting devices.

DE-OS 38 23 188 describes a sliding door system with an electrical drive motor, which is secured on the housing of the running rail. For this purpose, a dove-tail section is formed on the upper side of the running rail housing, into which the drive and control devices can be slid and can be fixed via a clamped mounting. In this known design the drive motor is in each case arranged vertically above the drive rail, whereby in practice only restricted possibilities of installation offer themselves.

In DE GM 93 02 490, the installation of the drive motor takes place in a similar manner via an adapter section for the optional mounting vertically above the running rail or horizontally at the side thereof. The adapter section can be fixed with clamping screws in the dove-tail arranged at the upper side of the running rail housing.

The object of the invention is to develop a sliding door system which has a drive with a compact construction and a low constructional height.

The object is satisfied in accordance with the invention by providing an arrangement wherein the drive and control devices are arranged in a receiving space which adjoins the running mechanism at the front side, with the receiving space and the running mechanism forming an assembled, substantially parallelepiped shaped body, the lower edge of which extends up to or engages over the upper edge of the wing, and the vertical constructional height of which is determined by the cross-section of the drive motor and/or by the vertical constructional height of the running mechanism and the horizontal constructional depth of which is at least twice as large as the vertical construction height. The drive is thus a compact, parallelepiped-shaped body with a low constructional height. It consists of a running mechanism and a receiving space, with drive and control devices arranged therein. All drive and control devices of the drive, i.e. of the sliding door system, are preferably arranged in the receiving space. In this respect the receiving space has approximately the same-sized cross-section as the running mechanism and both preferably have the same axial length, which extends over the entire door width. This drive can, as a result of its compactness and low constructional height, be built into a facade, for example a post/transom design, with optical advantages. The drive designed as a body in the shape of a parallelepiped preferably has approximately the same or identical constructional height as the cross-beam of the facade design, i.e. the transom. In preferred embodiments the constructional height of the drive amounts to 7 cm. Customary transoms are mainly 6 to 7 cm high.

The vertical constructional height of the parallelepiped shaped body forming the drive is preferably of the same size as the vertical constructional height of the running mechanism or of a section forming the housing of the running mechanism. This vertical constructional height can alternatively or additionally be of the same size as the diameter of the drive motor, preferably with the transmission and the drive pulley at the output side.

The running mechanism can be formed as an overhung element or can also be secured to a beam. In particular, when mounted on a beam, the running mechanism can also be divided into two in its axial extent. One sliding wing is guided via roller carriages in each of the two parts, with a cutout for the insertion of the roller carriages preferably remaining at the centre between the two parts.

The running mechanism or the carrier is secured to posts of a post/transom design, or to a transom of a facade. In this respect the running mechanism, i.e. the carrier, has approximately the same height as the transom, or can also be of fractionally greater height. The installation is made easier when the running mechanism or the carrier has a horizontal limb which lies on the transom. In an alternative embodiment, the running mechanism, i.e. the carrier, can also replace the transom.

In a preferred embodiment, the running mechanism has a box-like running mechanism section with two vertical limbs. The one vertical limb is hung into a carrier via a hanging device and is connected to the latter via a clamping device. The running mechanism and the carrier are in this design arranged behind one another when viewed from the front side of the door and lie with their respective front surfaces contacting. The other front side of the vertical limb has a horizontally extending, longitudinal groove of C- or T-like form, in which the drive and control elements are secured by clamping blocks with clamping screws. The mounting apparatus is designed in such a way that the drive and control devices can be variably placed therein, individually or in constructional groups. The clamping blocks are inserted from the side into the mounting groove, or are inserted into corresponding cutouts. The groove preferably extends at half the height of the running mechanism section. In alternative embodiments a plurality of mounting grooves can be arranged in parallel and/or displaced relative to one another in the longitudinal direction of the running mechanism section.

The receiving region in which the drive and control elements are located is surrounded by a cover hood, the upper edge of which is aligned with the upper edge of the running mechanism section and the lower edge of which lies beneath the upper edge of the sliding wing. Thus, a very compact housing arises, which is box-like on the whole, with a width which is approximately 2 to 3 times the height, consisting of a running mechanism section and the receiving region attached thereto, with at least the receiving region being covered over by the cover hood.

A driver, which connects the wing to a drive belt driven by the motor, is passed through between the running mechanism section and the receiving region for the drive and control elements. For this purpose the front side vertical limb of the running mechanism section is preferably of shorter design when compared to the second vertical limb. The drive belt driven by the motor is guided in a horizontal plane beneath the remaining drive units via deflection rolls with a vertical axis of rotation. In this arrangement the drivers likewise extend in a horizontal plane from the upper edge of the wing to the drive belts, with the upper edge of the wing lying at least approximately in the same horizontal plane as the drive belts.

For the guidance of the roller carriage the sectional housing of the running mechanism has a web on one or on both vertical limbs, which subdivides the sectional housing into an upper and lower region. In this respect the roller carriage is guided in the upper region on the webs formed as running surfaces, and the sliding wing engages into the lower region, at least in the region of the upper edge of the sliding wing. Alternatively, at least the essential vertical extent of the suspension device connecting the sliding wing to the roller carriage engages into the lower region.

The axles of rotation of the roller carriage can be arranged both horizontally and also vertically or angled to the horizontal. In a preferred embodiment, each rotational axle carries two running rollers with differently shaped running surfaces. Advantages in the guidance of the roller carriage result when one of the running surfaces is convex or concave, and the other running surface is of planar design. The running surfaces of the webs are in this case made complementary hereto.

One of the running rollers can have a cutout in the running surface, into which a resilient pull is received. The latter serves as an energy store for an emergency opening procedure.

The invention will be explained in more detail in the figures, in which are shown:

BRIEF DESCRIPTION OF THE DRAWINGS

FIG. 1 shows a front view of the sliding door system within a post/transom construction 8. The vertical posts 84 are supported on the floor and bound in at the ceiling, and are connected to one another via a horizontal transom 81. A sliding door drive is secured to this transom 81 at the front side. The sliding door drive is formed as a body in the shape of a parallelepiped, which extends over the entire door width. The body comprises a running mechanism 1 and a receiving space 55 with drive and control devices, such as, for example, drive motor, control unit and motion sensor. Two sliding wings 10 are guided via roller carriages in the running mechanism 1. The sliding wings 10 are moved by the drive motor. As can be recognised in FIG. 2, the running mechanism 1 is secured via the intermediately disposed carrier 3 to the transom 81. The carrier 3 and the transom 81 are located in FIG. 1 behind the running mechanism, whereas the receiving space 55 shown in FIG. 9 together with the drive and control devices is located in front of the running mechanism 1. The two sliding wings 10 are shown in closed position. Fixed field wings 12 are arranged to the side of the sliding wings 10, and are framed in at their sides by boundary posts 86 and posts 84.

DETAILED DESCRIPTION OF THE DRAWINGS

Figure 1:
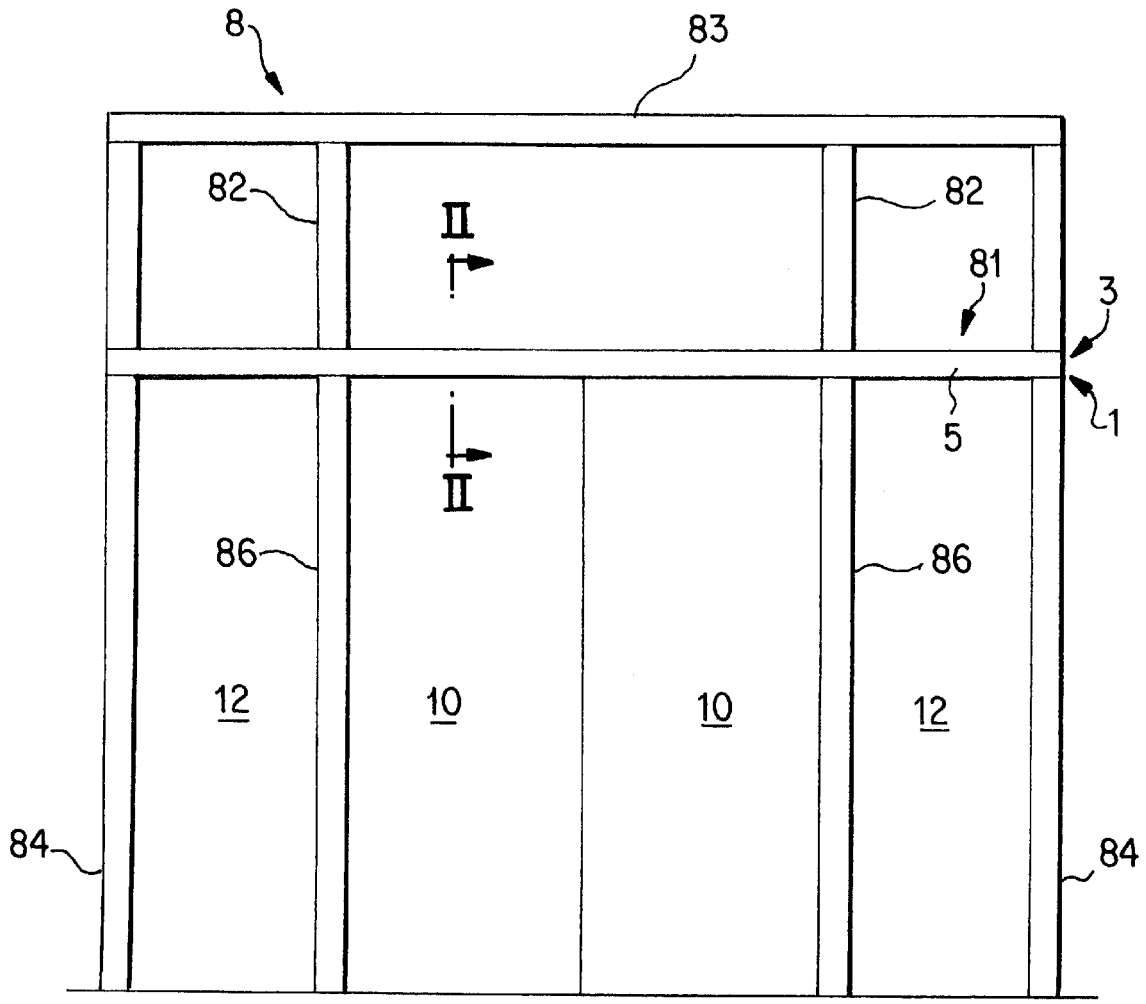
FIG. 1 a front view of a post/transom design with an overhung sliding door system.

In order to simplify the description, the terms running mechanism and running mechanism module and also carrier and carrier module will be used synonymously in the following. Whenever the talk is of running mechanism and carrier, this can accordingly also be a running mechanism module or carrier module.

In FIG. 2 the possibilities of mounting the running mechanism 1, or the optionally present carrier 3, to the transom 81 or to the post 84 are shown in four embodiments. In this respect the one vertical limb of the running mechanism section 63 in each case contacts the front side of the transom 81 or of a carrier 3 interposed therebetween.

Figure 2A:
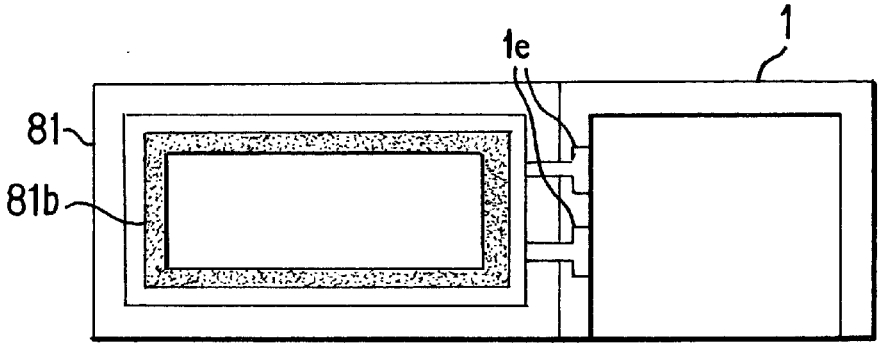
FIGS. 2*a* to *d* a section along the line II—II in FIG. 1, with a representation of different possibilities of attaching the sliding door system to the transom.
Figure 3:
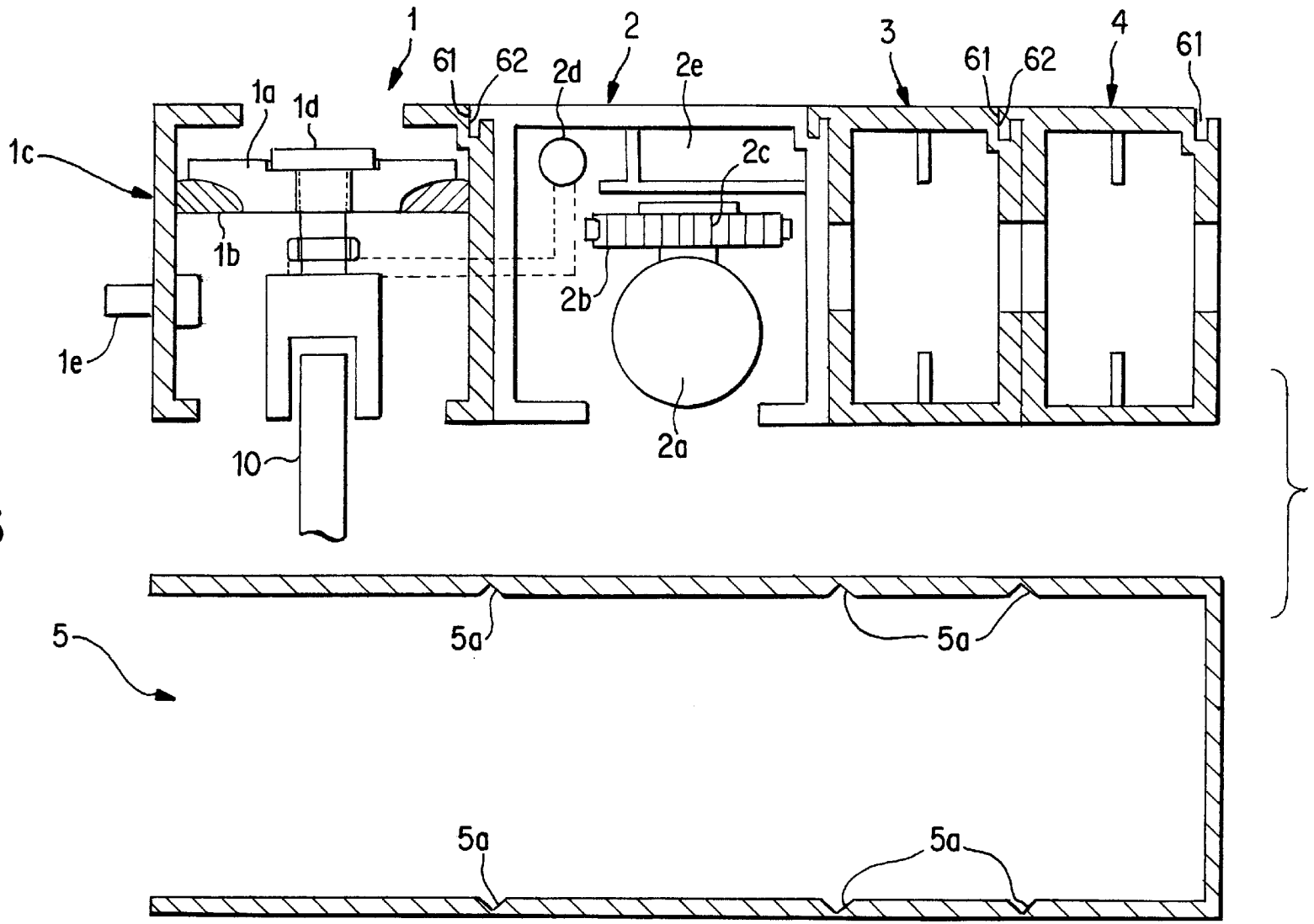
FIG. 3 a sectional view of an automatic sliding door system built up modularly in the region of the drive and a not-installed, U-shaped cover hood.

FIG. 2*a* shows a direct screwed embodiment 1*e* of the running mechanism 1 with the transom 81, as corresponds also to the illustration in FIG. 3. To increase the stiffness, a reinforcing section 81*b* shown dark is incorporated in the transom 81.

Figure 2B:
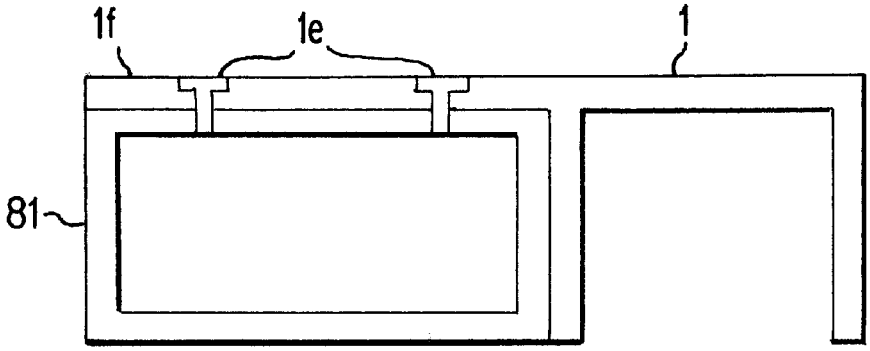
Figure 2C:
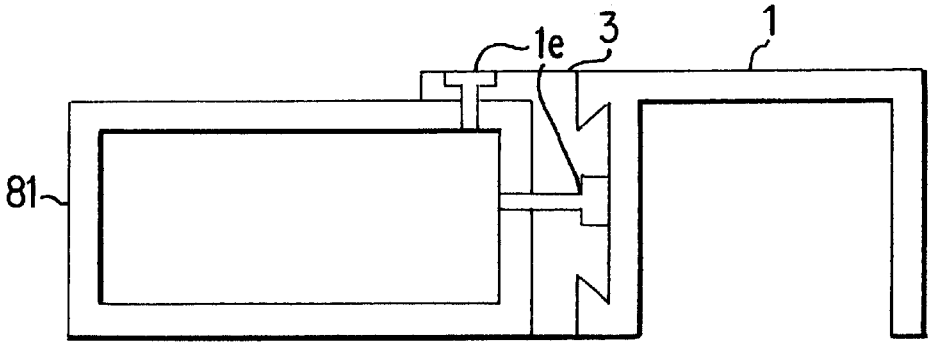

In FIG. 2*b* a horizontal rail if is arranged over the entire axial length of the running mechanism 1 at the upper edge of the running mechanism section 63 on the latter. In the installed state it lies on the transom 81 and is screwed to the latter. The embodiment in FIG. 2*c* corresponds to that in FIGS. 4 and 9, in which an L-shaped carrier section 3 is bolted to the transom 81, with a horizontal limb of the carrier section lying on the transom 81. The running mechanism 1 is connected to the carrier section 3 in FIG. 2*c* via a mounting apparatus with a dove-tail. In place of a bolted arrangement at the transom 81, the carrier 3 or also the running mechanism 1 can also be directly secured to the vertical posts 84. In this case one speaks of an overhung embodiment. Even with such an overhung installation, the carrier 3 can contact the transom 81 with its horizontal limb, as shown in FIG. 2*c*. Moreover, an additional support of the carrier 3 or the running mechanism 1 by the fixed field wings 12, or by their boundary posts 86, is possible. Likewise not shown are possible embodiments in which the carrier 3 or the running mechanism 1 partly or fully replaces the transom 81.

Figure 2D:
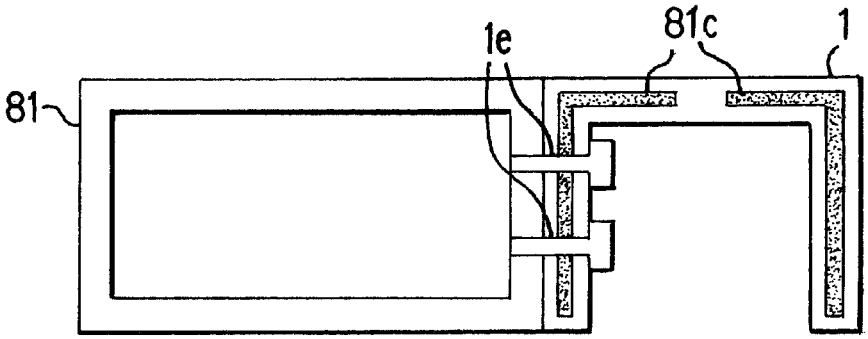

In an alternative embodiment illustrated in FIG. 2*d*, the running mechanism 1 takes on a stiffening or carrying function in the place of the carrier section 3. For this purpose, the running mechanism 1 is formed with two hollow chambers for the introduction of the darkly illustrated strip material 81*c* in L-shape. These are preferably steel rails which increase the stiffness of the running mechanism module 1, in the overhung installation which is necessary in the majority of applications.

In the embodiment shown in FIG. 3 one is concerned with a modularly built up sliding door drive comprising running mechanism module 1, motor and control module 2, carrier module 3 and also, furthermore, indication and/or communication module 4. All modules 1, 2, 3, 4 each have a sectional housing in the illustrated embodiment. The modules extend into the longitudinal sliding direction of the running mechanism, and preferably each extend over the entire width of the door. They are arranged behind one another parallel to one another in a common horizontal plane in the direction of viewing perpendicular to the door plane. They thereby contact each other with their respectively confronting front sides. They each have the same height H, for example 60 mm or 70 mm. They are arranged with respect to the aligned upper and lower sides, so that they form an assembled parallelepiped-shaped body of the height H.

The attachment of the modules 1, 2, 3, 4 to one another takes place by in-hanging. For this purpose undercut longitudinal grooves 61 are provided in the mutually confronting front sides and complementary, longitudinal edges 62, for example projecting longitudinal edges of hook-like cross-section, are provided which interengage. Additionally or alternatively, screw connections can be provided in the confronting front sides.

The mounting of the sliding door drive at the building side can, for example take place via a screw connection, as is shown in FIG. 3 in the region of the vertical housing limb of the running mechanism module 1. Alternatively, the carrier module 3 can be inserted in front of the running mechanism module 1, and the attachment can take place to the vertical housing limb of the carrier module 3.

The running mechanism module 1 shown in FIG. 3 has a sliding guide, which, in the illustrated embodiment, contains running rollers 1*a* with a vertical axis of rotation. The running rollers 1*a* run on running surfaces 1*b* of fixed position, which lie opposite to one another in a common horizontal plane. They are moulded onto oppositely disposed limbs of the sectional housing 63 1*c* of the running mechanism module. The running surfaces 1*b* are convexely curved, can, however, also be concave or formed as inclined planar surfaces. A plurality of running rollers are preferably provided in series in the running direction and roll off on oppositely disposed running surfaces, i.e. the one running rollers roll on the one running surface, and the other running rollers roll off on the other running surface.

The running rollers 1*a* have a vertical, rotational thrust bearing 1*d*. The axles vertically received in the bearings carry the sliding wing 10. For this purpose a suspension device with height adjustment is provided, which can be designed in the customary manner with a screw and nut.

The motor and control module 2 has a motor 2*a* and a non-illustrated control unit. The motor 2*a* is formed as a relatively narrow, essentially bar-like motor. The output drive pinion 2*c* is coupled for motion to the wing 10. For this purpose a transmission device, which is not shown in more detail, is provided between the drive pinion 2*c* and the wing 10. By way of example, a drive belt device of customary design can be provided with guide belts which circulate while being guided by deflection rollers 2*b*, with the one deflection roller 2*b* being driven by the motor 2*a*, and one run of the drive belt being connected to the wing 10 via a driver.

In the embodiment shown in FIG. 3 a rubber cord 2*d* is, moreover, received in the motor and control module. Its one end is secured to the wing 10, and its other end is secured to the sectional housing of the module 2. The rubber cord is tensioned during motor closing of the wing. On power failure, the rubber cord ensures the automatic opening of the door. In this respect, provision is made in FIGS. 4 and 5 for the rubber cord 2*d*to be guided in space-saving manner in a cutout within the running surface of the running rollers 69*a*. Moreover, a hollow section chamber, in which the electrical cables 2*e* are guided, is provided in the motor and control module 2.

The carrier module 3 in FIG. 3 has a sectional housing in the same manner as the previously described modules 1 and 2. Two hollow section chambers are formed therein. A strip material can be received in both chambers for the carrying function. The dimensioning of the strip material is dependent on the stability requirements. Alternatively, an indicator and/or communication device can be introduced into one of the chambers instead of the strip material. A separate display and communication module 4 can be arranged at the outer front side of the overall unit.

The overall unit can be covered over via a cover hood 5 of U-shaped cross-section. Positions of intended fracture 5*a* or markings are provided in the U-limbs of the hood 5 in order for the dimensions of the hood 5 to be easily adapted to the overall arrangement.

Figure 4:
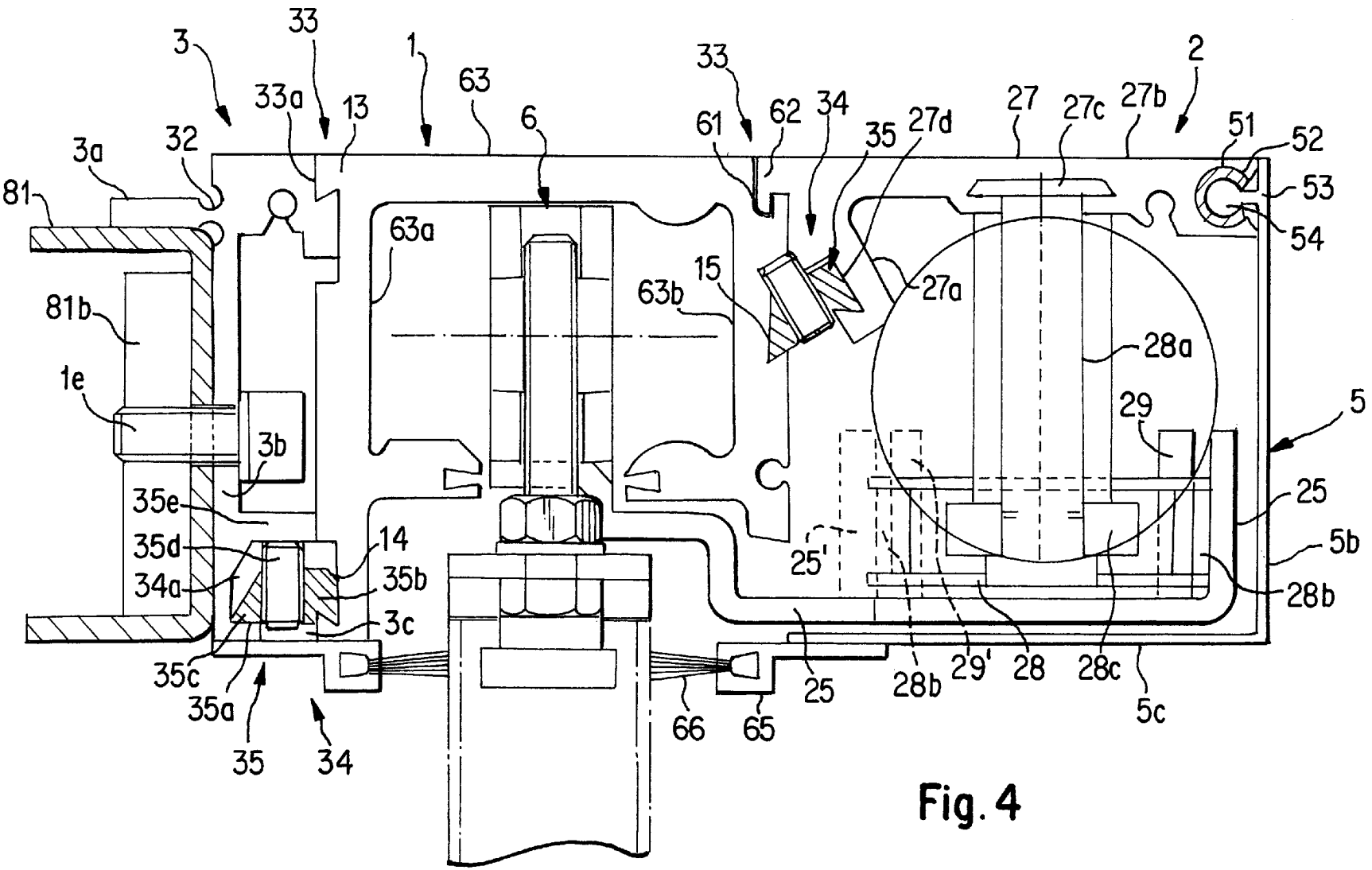
FIG. 4 a sectional view of a further embodiment of an automatic sliding door system of modular design, without representation of the roller carriage.

FIG. 4 shows a modified embodiment of the sliding door drive. As already described in FIG. 2*c*, an L-shaped carrier 3 is secured to the posts 84 or also to the transom 81 of a post/transom construction present at the building side. In this arrangement the carrier 3 extends over the entire height of the transom 81 and has a short limb 3*a* which lies on the horizontal upper edge of the transom 81. The lower edges of the transom 81 and of the carrier module 3 lie at the same level. The carrier module 3 is bolted by mounting bolts 1*e* to the transom 81 and to a reinforcing section 81*b* received in the interior of the transom 81.

The attachment of the running mechanism 1 to the carrier 3 takes place by an in-hanging device 33 and a clamping device 34. The in-hanging device 33 comprises a first, dove-tail groove 33*a* close to the upper horizontal edge at the vertical limb 3*b* of the carrier 3. A first dove-tail section 13, which is formed in the sectional rail 63 of the running mechanism 1 at the same height, is hung into this. After the hanging into place, the upper and lower edge of the carrier 3 and of the running mechanism 1 lie at the same level. The clamping device 34 with the clamping pieces 35, which are respectively arranged beneath the hanging-in device 33, preferably at the lower horizontal edge of the carrier 3, serve for the fixing of the modules 1 and 3, which are hooked together via the in-hanging device 33.

The attachment of the motor and of the control module 2 to the running mechanism 1 likewise takes place by simple in-hanging and clamping at the mutually confronting front sides, with the hanging-in device 33 and the clamping device 34.

The motor and control module 2 shown in FIG. 4 has a sectional housing 27, which is identical from the point of view of the dimensions to the running mechanism module 1. In the downwardly open sectional housing 27, a toothed belt 28*b* is guided over two deflection rollers 28, which are respectively journalled in a rotary bearing 28*c* on vertically disposed axles of rotation 28*a*. one of the two deflection rollers 28 is driven by a bar-like motor 2*a*. Both the deflection rollers 28 and also the drive motor 2*a* can be slid into the housing 27 and fixed at the desired position with clamping bolts. For this purpose, the sectional housing 27 has at its upper horizontal limb 27*b* a sliding guide 20*c*, which extends in the longitudinal direction of the section. An advantage of this is that the position of the deflection rollers 28 can be ideally matched to the width of opening of the door on location.

The driver yoke 25 secured to the roller carriage 6 engages into the motor and control module 2. In order to enable the passage within the housing 5, both the vertical limb 63*b* of the running mechanism module 1 and also the vertical limb 27*a* of the motor and control module 2 are of shorter design. The driver yoke 25, which extends essentially in a horizontal plane, is secured to the drive belt 28*b* in a customary manner via clamped connections 29. In this arrangement the driver 25 for the first sliding wing 10 passes beneath the toothed belt 28*b* and the deflection rollers 28 and has a vertical, upwardly bent end 25*b* connected at the oppositely disposed side to the one run of the toothed belt 28*b*. A second, oppositely moving wing 10 is connected in similar manner to the other run of the toothed belt 28*b*, but without passing beneath the deflection roller 28.

The sectional housing 27, which is open at the front side, is provided with an L-shaped cover hood 5, which has a vertical limb 5*b* and a horizontal limb 5*c*. The mounting takes place at the front side to the motor and control module 2 by clipping it into a horizontally extending groove 51 at the upper horizontal edge of the motor and control module 2.

By using the same modules, drives can be produced in corresponding manner for different door types, for example for one-wing and two-wing sliding doors. Furthermore, telescopic sliding door drives can also be produced, for example in that two running mechanism modules 1 are inserted in parallel alongside one another.

Figure 5:
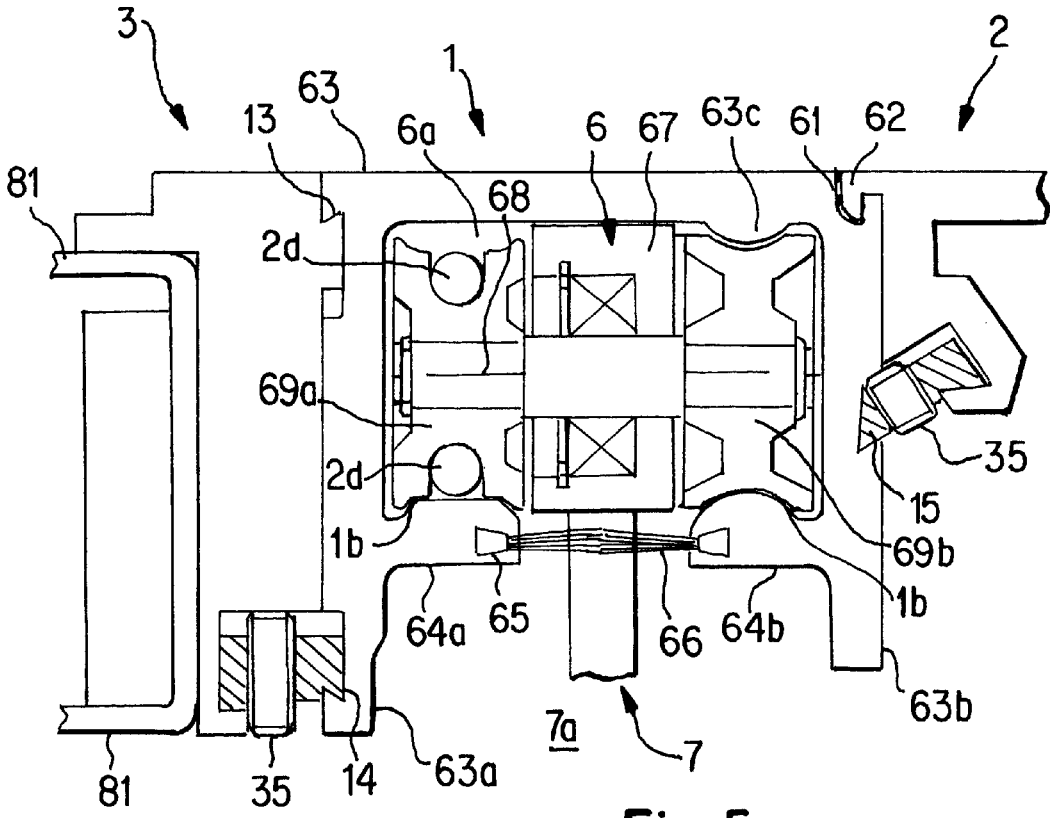
FIG. 5 an enlarged, detailed view of the running mechanism in FIG. 4 with representation of the roller carriage.

FIG. 5 shows an enlarged representation of the running mechanism module in FIG. 4. On the two vertical limbs 63*a* and 63*b* of the running mechanism section 63 there is in each case provided a horizontal central web 64*a* and 64*b*, which divides the section into an upper region 6*a* and a lower region 7*a*. At the centre an opening remains in the design for the passage of the suspension and adjustment device 7 for the non-illustrated sliding door 10. The central webs 64*a*, 64*b* are formed as running surfaces 1*b*, 1*b*' for the roller carriage 6, with the one central web 64*b* having a running surface 1*b*' with an arched cross-section, and the other central web 64*a* having a running surface 1*b* with a flattened cross-section. The webs 64*a*, 64*b* have mutually confronting receiving grooves 65, with sealing brushes 66 arranged therein throughout.

The roller carriage 6 comprises an elongate, basic body 67, in which two through-going horizontal axles 67 arranged in series are mounted. Each of the axles 68 carries two outwardly disposed, differently shaped running rollers 69. The running roller 69 of the roller carriage 6 is guided in the upper region 6*a* of the sectional rail 63 on the centre web 64*a*, 64*b*. In correspondence with the design of the running surfaces 1*b*, 1*b*', the rollers 69*a* arranged at the left side relative to the running axle, have a flattened running surface 1*b*, and the rollers 6*b* arranged at the right side have an arched running surface 1*b*'. The flattening of the running surface 1*b* serves to compensate for tolerances. In order to increase the security of guidance, an arched support section 63*c* is provided, which is complementary to the section of the guide roller 69*b*. This support section 63*c* is arranged at the upper side of the chamber 6*a* opposite to the likewise arched running surface 1*b*' of the central web 64*b*. In this arrangement, the support section 63*c* engages into the contour of the running roller 69*b*, but does not, however, contact the running roller 69*b*. The roller carriage basic body 67 is also guided with only a small distance to the section 63, without, however, contacting it. In this manner a "lifting off" of the roller carriage 6, or indeed a jumping out of the guide, is prevented.

The running rollers 69*a* with the flattened running surface 1*b* each have a peripherally extending cutout within the running surface 1*b*. This serves to receive a rubber cord 2*d*, which brings about the opening of the sliding wing in emergency operation. The rubber cord 2*d*is connected at one end to the sliding wing 10, and at the other end is supported at a fixed location, can, however, also be moved in prestressed form with the wing. It serves as an emergency drive for the emergency opening of the sliding wing 10 on failure of the motor 2*a*. In modified embodiments the rubber cord 2*d* can also be used for emergency closing.

Figure 6:
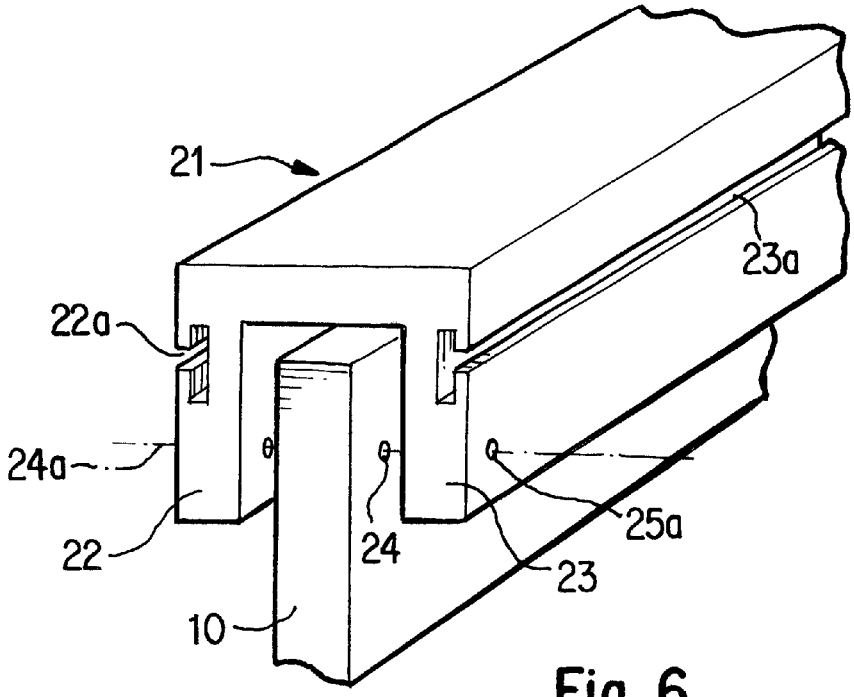
FIG. 6 a schematic, sectional illustration of a roller carriage of a modified running mechanism module.

Roller carriages can also be used which, as shown in FIG. 6, have a U-shaped sectional body 21, which is open downwardly towards the wing 10. Non-illustrated running rollers are arranged at the sides of the U-shaped limbs 22, 23, which face away from one another, with the mounting axles of the running rollers being clampingly received in undercut, elongate grooves 22*a*, 23*a* at the outer sides of the U-limbs. Transverse bolts 24, which are arranged in oppositely disposed bearings in the U-limbs, are provided for the suspension of the wings 10. The bearings have an eccentric device, so that through rotation of the transverse pin, a vertical adjustment of the wing 10 suspended on the transverse pin can take place.

Instead of running rollers with vertically or horizontally arranged axles, running rollers with axles of rotation arranged at an angle to the horizontal can also be used, preferably with cross-wise offset running rollers arranged in series in the running direction. Through the different arrangement of the running rollers, embodiments of running mechanism modules 1 with different cross-sectional dimensions are possible.

Figure 7:
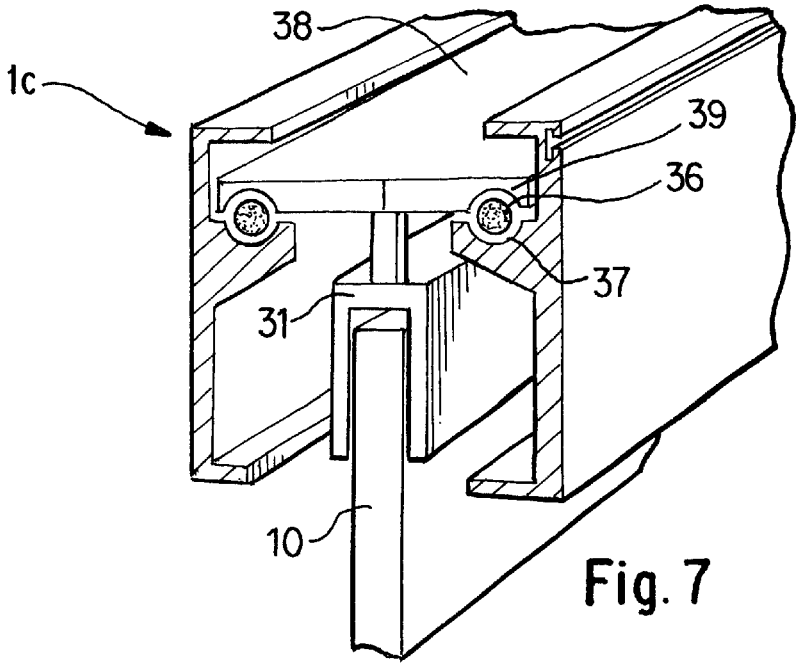
FIG. 7 a schematic sectional representation of a further modified running mechanism module with running balls.

Alternatively, running mechanisms with running balls can also be designed. In the running ball mechanism shown in FIG. 7, the balls 36 run in a running groove 37 in the running mechanism housing 1*c*, and support a bearing plate 38 with a corresponding running groove 39. A suspension device for the sliding wing 10 with a U-shaped receiving body 31, which is similarly designed to the bodies 21 in the FIGS. 3 and 6, is suspended in the bearing plate 38. The bearing plate 38 can form the body of a running carriage, which has three running balls at each of the two running sides. As in the previously described running mechanisms, the sliding wing also engages here into the running mechanism housing, so that the upper edge of the sliding wing is guided in hidden manner.

Figure 8:
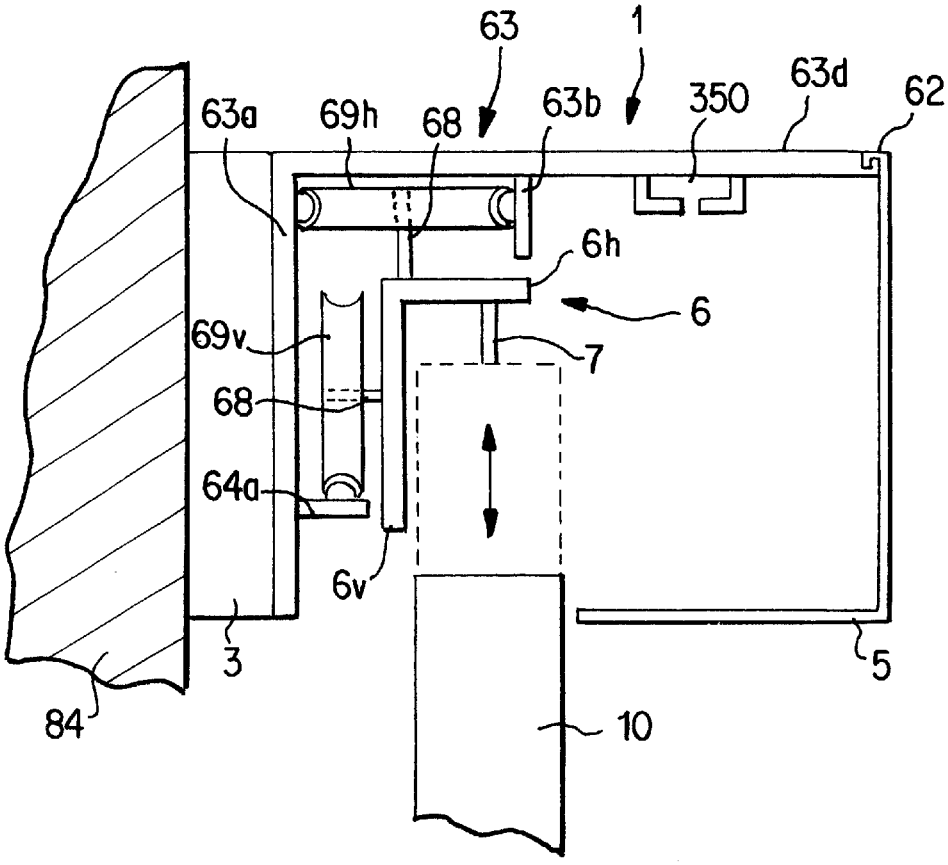
FIG. 8 a schematic sectional illustration of a further modified running mechanism module with an L-shaped roller carriage.

A further embodiment of a running mechanism 1 with one vertically and one horizontally arranged running roller 69*v* and 69*h* respectively is shown in FIG. 8. The substantially L-shaped housing 63 of the running mechanism 1 is secured to a post 84 via an intermediate carrier element 3. The housing 63 has a vertical limb 63*a* contacting the carrier element 3 and having a horizontal web 64*a* and an upwardly disposed elongate horizontal limb 63*d*, as well as a shorter vertical limb 63*b* arranged approximately in the middle of the horizontal limb 63*d*.

The axle 68 of the vertically upright running roller 69*v* is journalled in a vertical limb 6*v* of an L-shaped roller carriage 6. This roller 69*v* runs on the horizontal web 64*a*. A second running roller 69*h* lying horizontally, i.e. with a vertical axis of rotation, is arranged above the roller carriage 6 and the vertical running roller 69*v*. This second running roller 69*h* acts as a support roller and prevents a tilting of the roller carriage 6 with the wing 10 secured thereto. It can be braced against the limb 63*b* or the limb 63*a*.

The roller carriage 6 in the form of an inverted "L" now forms, beneath its vertical limbs 6*v*, an additional receiving space for the vertical adjustment of the wing 10. In this design the wing is connected to the horizontal limb 6*h* of the roller carriage 6 via a suspension and adjustment device 7 of customary design. Alternatively, the wing 10 can be secured via a suspension and adjusting device on the vertical limb 6*v* of the roller carriage 6.

Close to the outer end of the horizontal limb 63*d* of the sectional housing 63, a receiving groove 350 is present at its lower side for the attachment of drive and control elements. The front side of the sectional housing 63 is closed off by an L-shaped cover hood 5, which is hung in at an upper horizontal front edge of the sectional housing 63, at an upper longitudinal edge 62. In this arrangement the lower horizontal limb of the cover hood 5 extends directly up to the sliding wing 10 and lies at the same level as the carrier element 3 and the left hand vertical limb 63*a* of the sectional housing 63. As in the previously described running mechanisms, the sliding wing 10 also engages here into the running mechanism housing 63, so that the upper edge of the sliding wing is guided in hidden manner.

In the embodiment shown in FIGS. 9 to 16, one is concerned with a modification of the embodiment in FIG. 4. The motor and control devices, for example drive motor 2*a*, control 2*f* and also further elements shown in the subsequent Figures, such as, for example, the radar 220, the deflection roller 28, the transformer 240 and the latching device 9, are arranged on the correspondingly assembled running mechanism 1, in a receiving groove 350 arranged at the front side of the box-like running mechanism housing 63, via clamping blocks 351 with clamping bolts 352. In this design the additional hanging device 33 at the upper edge of the running mechanism housing, as in the embodiment of FIG. 2, is dispensed with here. The receiving groove 350 is substantially T- or C-shaped. It lies horizontally in the central region of the front side of the running mechanism housing 63, at the vertical limb 63*b* thereof. The drive units and all further components can be inserted into the receiving groove 350 in series and can each be secured individually via a clamp mounting 351, 352, which is described in detail in FIG. 11. Alternatively, a plurality of horizontally extending receiving grooves can also be provided in the front side.

In an alternative embodiment, the clamping blocks 351 are dispensed with. Preferably, components can be secured in a receiving groove by simple hooking in and subsequent securing, for example with a screw, or for example with a latchable bearing connection.

The drive and control devices secured by clamping in the receiving groove 350 are covered over by a U-shaped cover hood 5, which substantially forms a parallelepiped-shaped receiving space 55 for the drive units. The parallelepiped-shaped receiving space 55 formed by the U-shaped cap 5 adjoins the box-like running mechanism section 63 of the running mechanism 1, with the upper horizontal edge of the receiving space or cap 5 being aligned with the upper horizontal edge of the running mechanism 1 and likewise with the lower horizontal edge of the receiving space or the cap 5 being aligned with the lower edge of the vertical limb 63*a* of the running mechanism 1 and the lower edge of the vertical limb 3*b* of the carrier 3. The cross-section of the receiving space 55 is rectangular and so arranged that the horizontal edge is longer than the vertical edge, preferably 1.5 to 2 times as long. The cross-section of the running mechanism section 63, in which the roller carriages are arranged including the suspension and adjusting device 7 for the wing 10 is substantially square, with the vertically extended limb 63*a* being approximately as long as the horizontal edge of the running mechanism cross-section.

A cutout 7*a* is formed between the vertical limb 63*a* and the box-like housing part which receives the running carriage 6, with the suspension and adjusting device 7 and also the upper edge of the wing 10 being engagingly arranged in the cutout 7*a*. The cutout 7*a* is open towards the receiving space 55 as a result of the shortened limb 63*b*, in the figure the right hand limb, so that the driver 25 can pass through.

The total drive comprising the carrier 3, running mechanism 1 and drive units thus receives a rectangular shape, with the long edge being horizontal and the short edge being vertically arranged. The upper edge of the wing 10 engages into this rectangular drive box, so that the upper edge of the wing 10 is covered over, i.e. at the front side, by the front side of the drive or by the cover hood 5.

Figure 9:
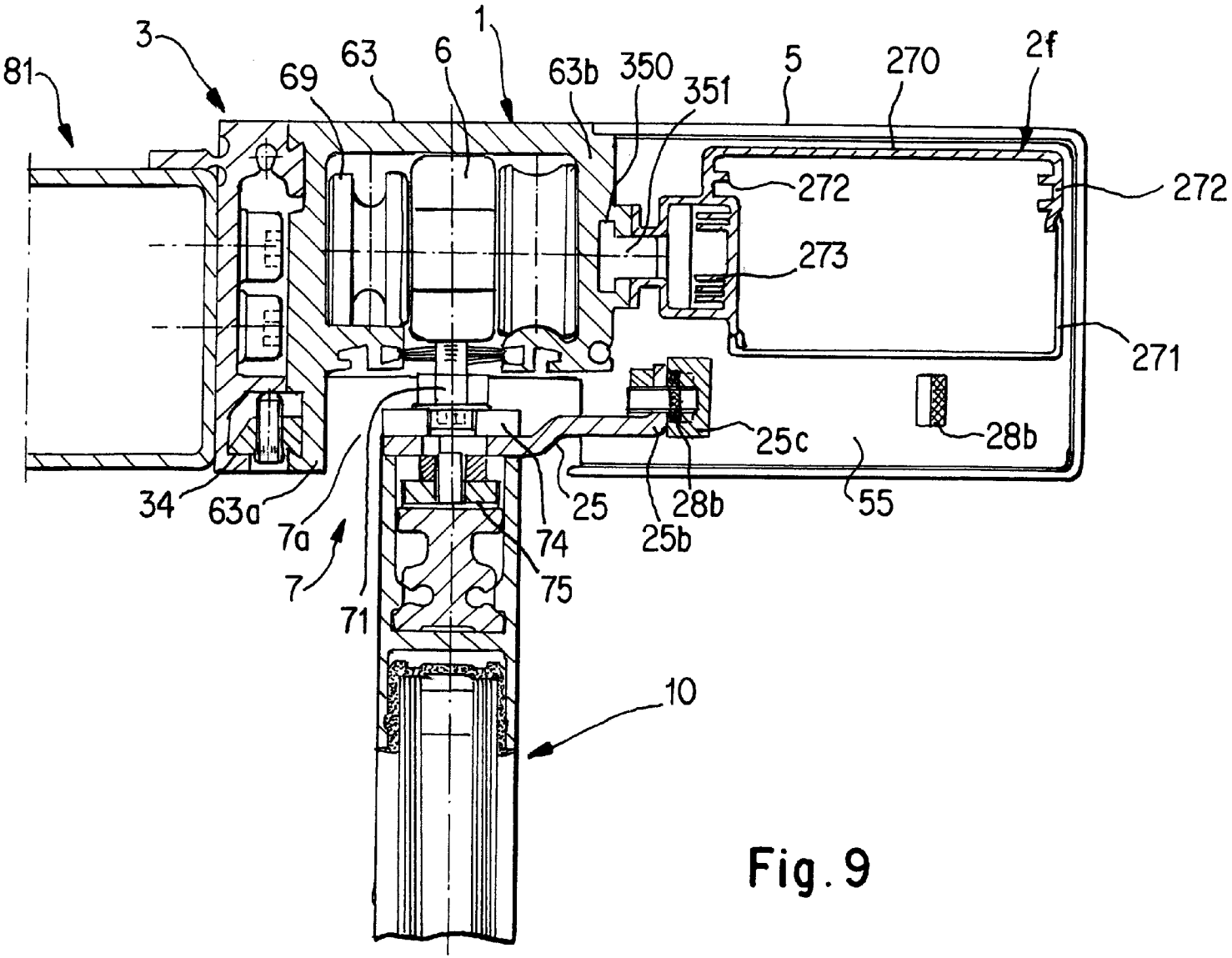
FIG. 9 a sectional illustration of a modified embodiment relative to FIG. 4, sectioned in the region of the control device of the drive.

In the sectional illustration of FIG. 9 the control unit 2*f* can be recognised. It has an elongate box-like shape and is arranged directly above the drive belt plane. The drive belt 28*b* is guided in the receiving space 55 in a lower horizontal plane via deflection roller 28 (FIG. 11) and drive wheel 2*c* (FIG. 15). The motor 2*a*, the control unit 2*f* etc. are arranged above this plane in the receiving space 55.

The control unit 2*f* (FIG. 9) comprises a housing upper part 270, which receives a non-illustrated control circuit board and is clampingly secured in the front side groove 350, as well as an L-shaped cover 271, which is plugged from below onto the upper part 270. The control circuit boards are introduced from the side into two corresponding, horizontally extending insert grooves 272 within the upper part 270.

The drive belt 28*b* is shown beneath the control unit 2*f*, and also the driver yoke 25 connected to the first door wing 10. Since the right hand limb 63*b* of the running mechanism section 63 ends at the level of the central web 64*b*, the driver yoke 25 can be guided in a horizontal plane from the upper edge of the wing to the drive belt 28*b*. In this arrangement the upper edge of the wing lies approximately in the plane of the drive belt. The driver yoke 25 extends in this arrangement just above the lower limb of the cover hood 5. It is screwed onto the base plate 75, on which the suspension and adjusting device 7 is secured, and which is inserted into the upper edge of the wing. At the drive belt side, the driver yoke 25 has an upwardly bent end 25, which is bolted to a counterpiece 28*c*, with the drive belt 28*b*, which is split at this point, being clamped between the end 25*b* of the yoke and the counterpiece 25*c*. The drive belt 28*b* is in each case split at the mounting position of the driver yoke, i.e. divided into two.

The suspension and adjusting device 7 is designed in customary manner, in that the sliding wing 10 is mounted via a yoke 74 on a vertically adjustable threaded screw 71. The sliding wing can be lifted or lowered by rotating in or out the threaded bolt 71, which is journalled in a counterthread within the roller carriage 6.

Figure 10:
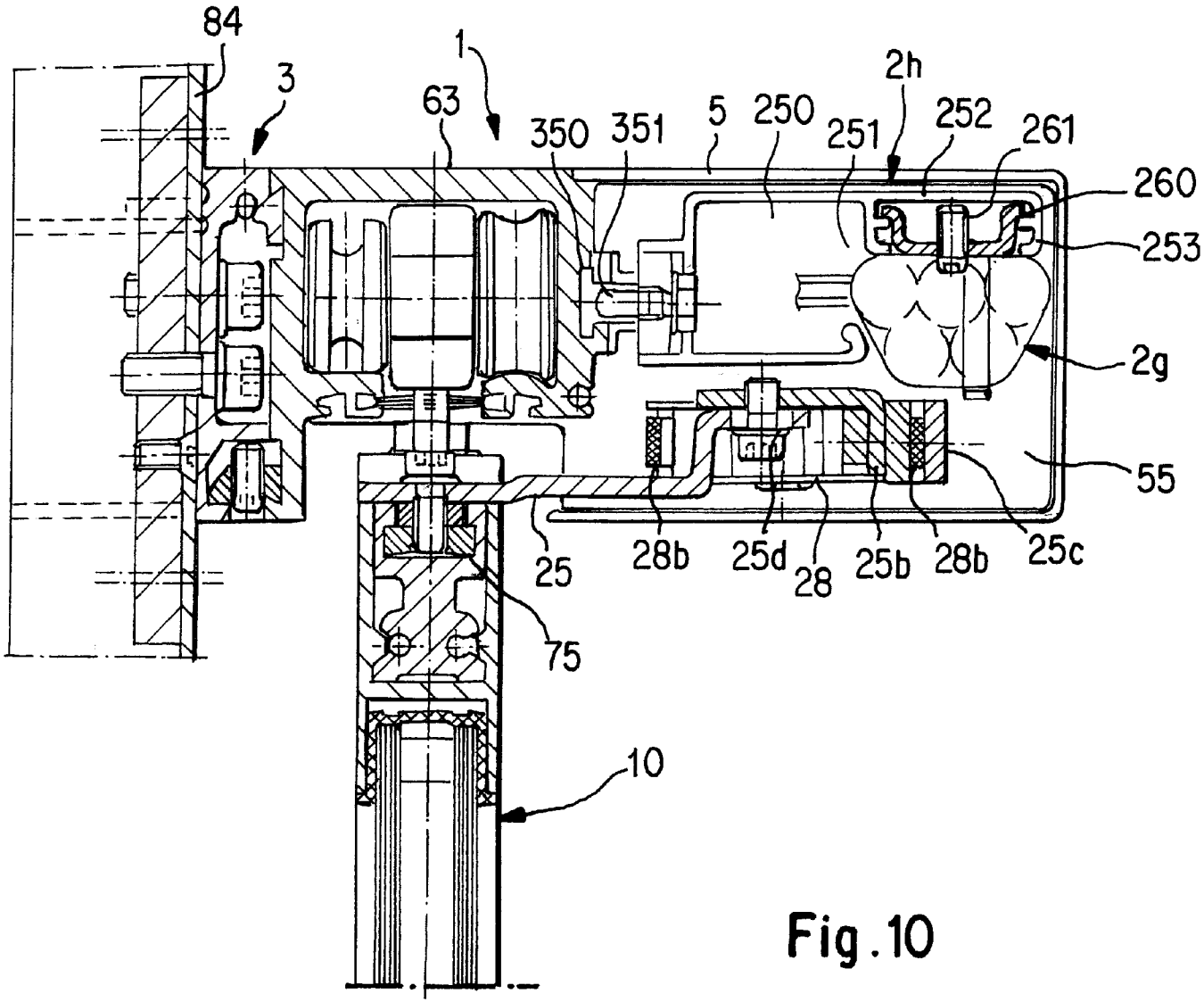
FIG. 10 a sectional illustration corresponding to FIG. 9, sectioned in the region of the accumulator pack and of the cable holder/cable channel.

In FIG. 10 the driver yoke 25 of the second wing 10 and also the deflection roller 28 lying behind it are shown. The driver yoke 25 is passed here, starting from the upper edge of the wing, horizontally under the front drive belt 28*b*, and has a U-shaped end which engages into the plane of the drive belt. The central piece of the U-shaped end has an adjusting device 25*d*, via which the yoke length can be set. The yoke end 25*b* is also bolted here to a counterpiece 25*c* and clamps the toothed belt 28*b*, which is split at this point. In an alternative design, the driver yoke 25 can also be guided above the drive belt 28*b*.

The cable channel 2*h*, which is likewise clampingly secured in the front side groove 350 of the running mechanism 1, is arranged above the drive belt plane in FIG. 10. It has, on the whole, a rectangular shape and has a functional division into two. The left hand half 250 is closed on all sides, apart from an insertion opening 251 at the vertical front side and serves for the guidance of loose cables. The right hand half 252 is open downwardly and has insertion grooves 253, extending in the longitudinal direction at the upper side to receive functional components. Illustrated are, for example an accumulator pack 2*gh*, which is secured via a bolted arrangement 261 to a yoke 260, which was introduced horizontally into the insertion grooves 253 of the cable channel 2*h*.

The accumulator pack 2*g* serves for the emergency opening or closing of the door in the event of power failure, in particular for escape and rescue doors.

Figure 11:
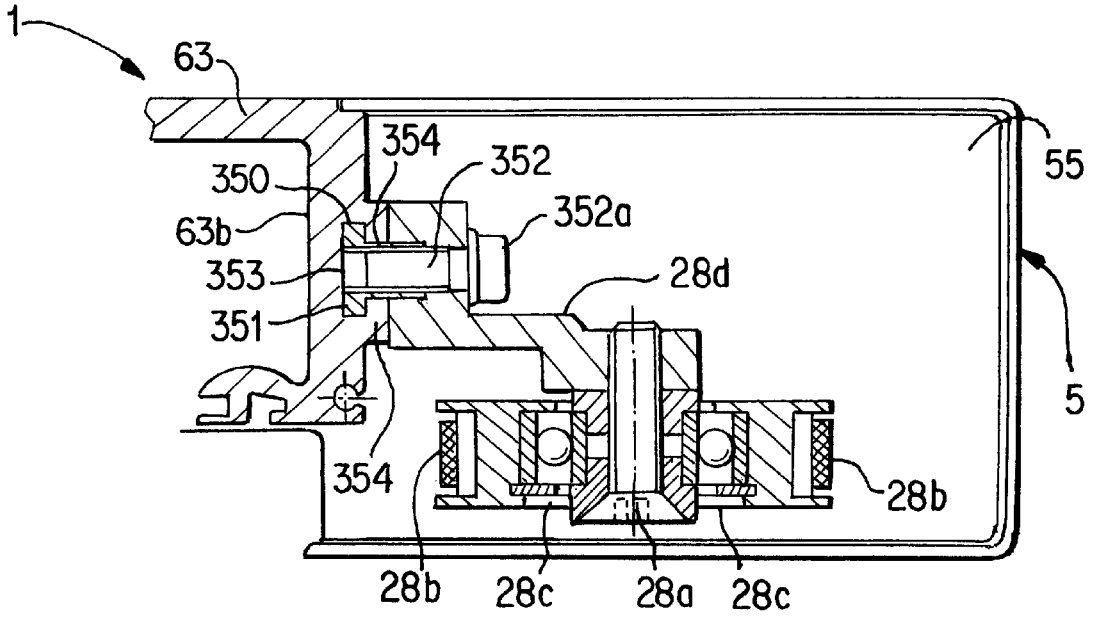
FIG. 11 a sectional illustration in accordance with FIG. 9, sectioned in the region of the deflection roller.

FIG. 11 shows a sectional illustration of the receiving space 55, bounded by the cover hood 5 in the plane of the deflection roller 28. A downwardly pointing, almost L-shaped holding arm 28*d*, which carries the deflection roller 28, is clampingly secured at its vertical limb by clamping screws 352 in the front side groove 350 on the running mechanism module 1. The horizontal limb of the holding arm carries the vertical axle of rotation 28*a* of the horizontally disposed deflection roller 28. The deflection roller 28 is journalled on its axle rotation 28*a* via a rotary bearing 28*c*. The toothed belt 28*b* guided on the deflection roller 28 is also shown.

The horizontally extending, T-shaped groove 350 is approximately centrally arranged on the front side of the vertical limb 63*b* of the running mechanism housing 63, with it extending over the full length of the sectional housing 63. The groove bounding strips 354 are formed on the vertical limbs 63*b* on both sides of the groove 350. The T-shaped clamping block 351, which is likewise received in the groove 350, has a threaded bore 353, and projects out of the T-groove 350. The holding arm 28*d*, which carries the deflection roller 28, lies areally on the groove bounding strips 354, with the end of the clamping block 351 projecting out of the groove 350, being received in a cutout of the holding arm 28*d*. A clamping bolt 352 is passed through the holding arm 28*d*, and engages into the threaded bore 353 of the clamping block 351, and its screw head 352 contacts the holding arm 28*d*.

Through the clamping bolt 352, the T-shaped end of the clamping block 351 is drawn from the rear side against the projection 354, which closes off the groove 350 at the front side, and simultaneously the holding arm 28*d* is pressed from the front against the groove bounding strips 354. The clamping blocks 351 and the holding arm 28*d* are thus firmly connected to one another and secured against further displacement. All further drive and control elements are also clampingly secured in the groove 350 in the same manner.

Figure 12:
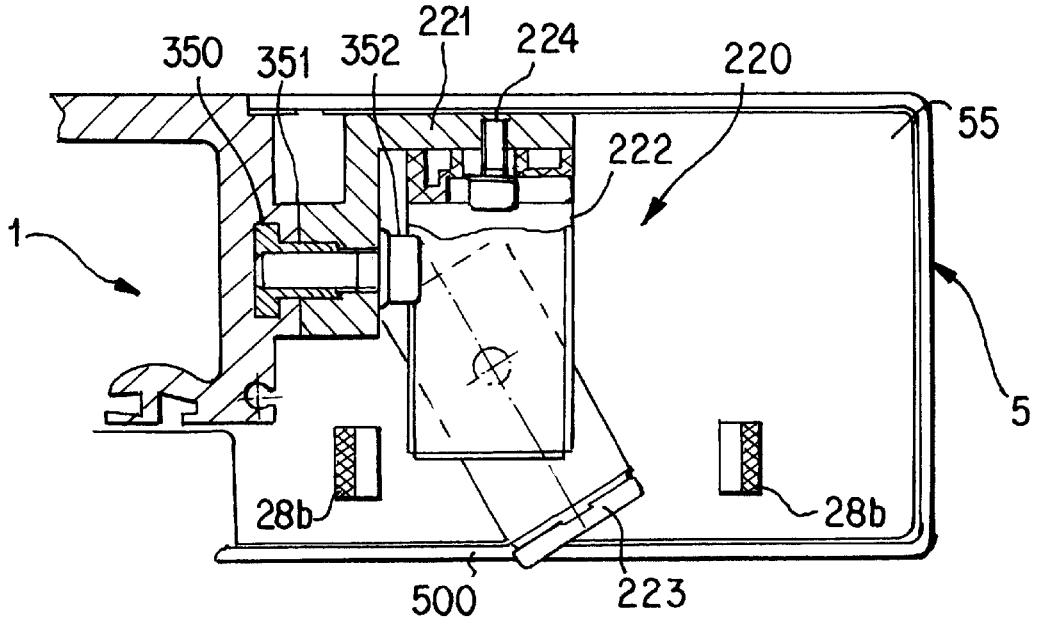
FIG. 12 a sectional illustration in accordance with FIG. 9, sectioned in the region of the control sensor.

The radar movement sensor 220 for the control of the door is depicted in the sectional illustration of FIG. 12. The housing 222 of the radar movement sensor 220 is in this arrangement secured to the lower side of the vertical limb of an upwardly pointing, almost L-shaped holding arm 221 via a bolted connection 224. The holding arm 221 is likewise clampingly secured in the front side groove 350 at the running mechanism module 1.

The sensor 223, which is pivotable around a horizontal axis, is arranged on the housing 222 and engages between the two toothed belts 28*b* into the drive belt plane. In order to enable the sensor to have free sight of the door vestibule, the cover hood 5 has a cutout 500 beneath the radar 220.

The holding arm 221 for the radar 220 can, moreover, serve as a support for the cover hood 5 contacting the holding arm 221. The additional holding arm 520 shown in FIG. 16 can thus be omitted. It is of particular advantage if the holding arm 221 simultaneously serves as a cable guide. For this purpose cables can be inserted from above into the cutout between the holding arm 221 and the running mechanism 1.

Figure 13:
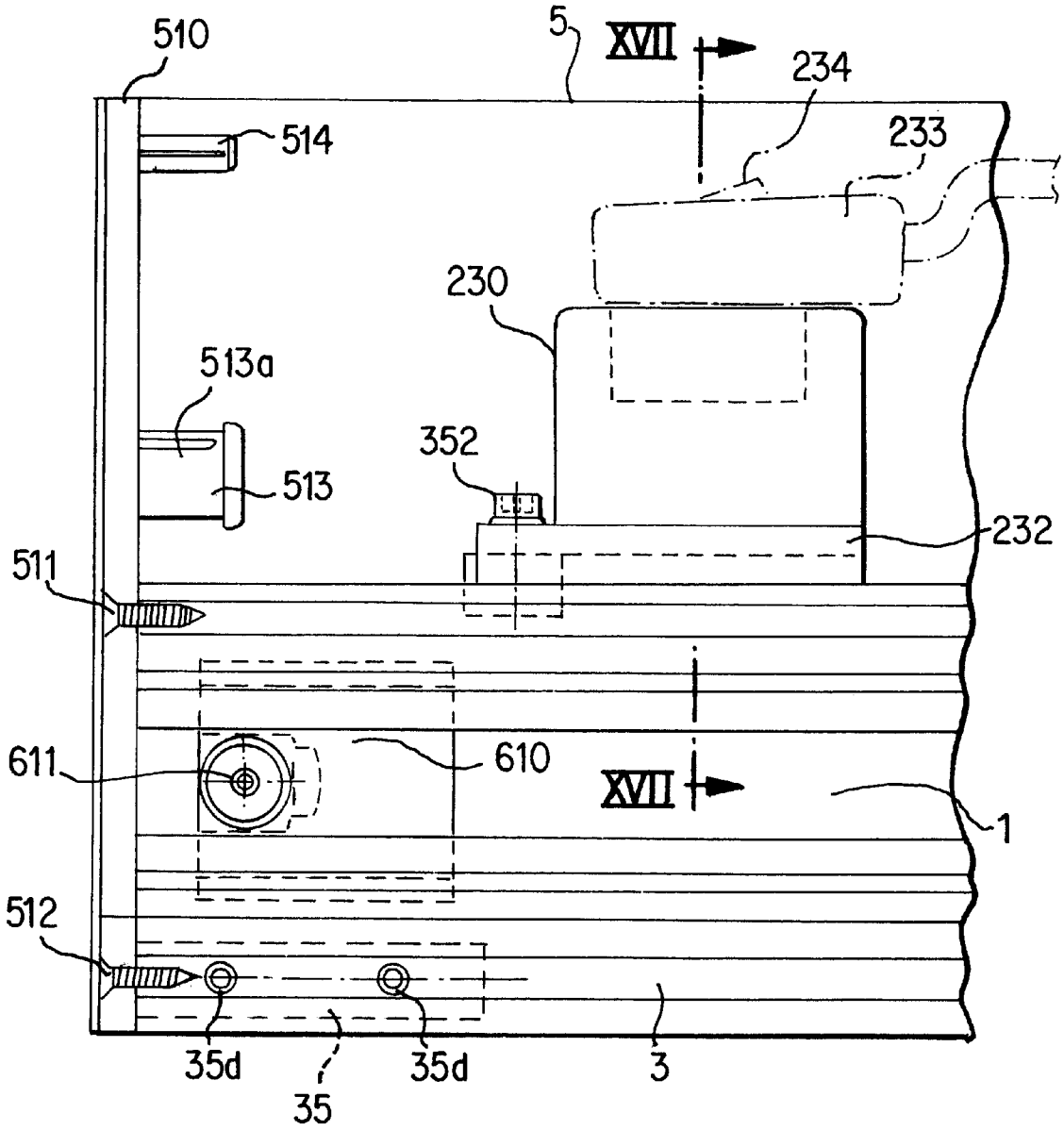
FIG. 13 a sectional illustration of the side part of the embodiment of FIG. 9.

The left hand outer end of the door drive 3 with the side part 510 is shown in section in FIG. 13. The side part 510 is secured via a first bolt 511 to the side of the running mechanism 1 and via a second bolt 512 to the carrier 3. When seen from the side, the side part 510 covers over both the receiving space 55 and also the carrier 3 and the running mechanism section 63. The height of the side part 510 is identical to the height of the running mechanism 1, of the carrier 3 and of the cover hood 5. The side part 510 simultaneously serves as a seat for the cover hood 5.

A socket 230 for the connection to the power supply of the sliding door system is also shown in FIG. 13, as well as the left hand elastic buffer 610, which prevents the roller carriage 6 running out onto the side part 510. The socket 230 is secured in the front side groove 350 at the running mechanism 1. The buffer 610 is secured via a screw fitting 611 within the running mechanism section 63.

Figure 14:
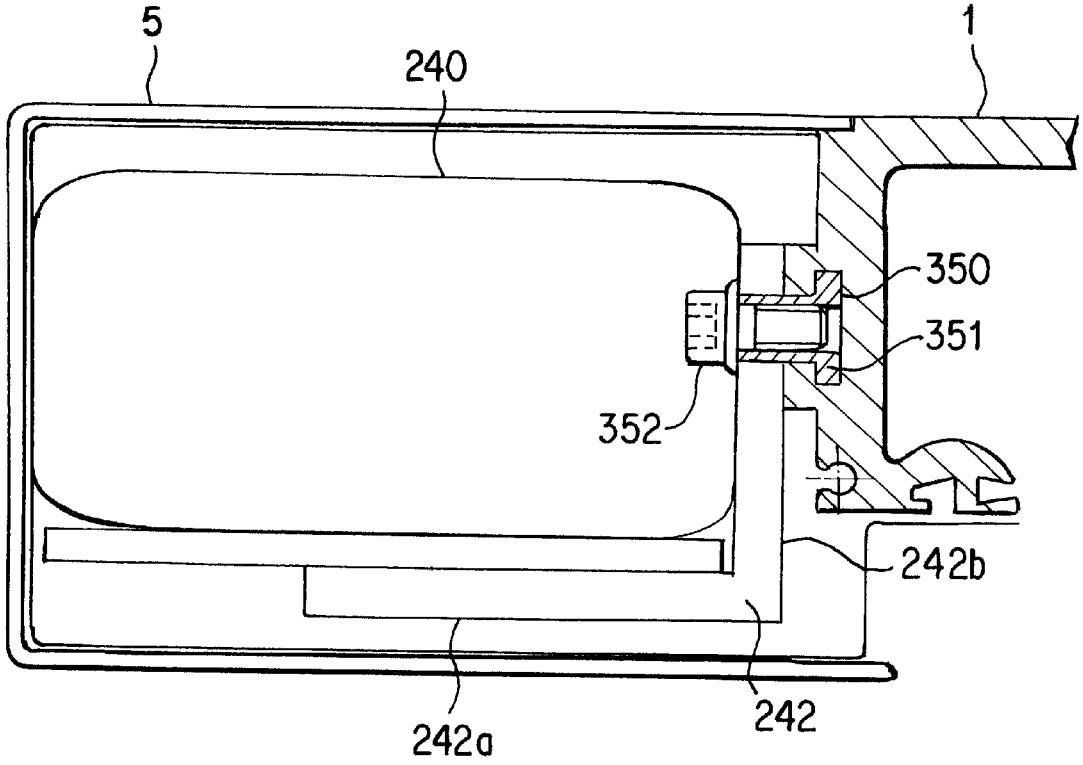
FIG. 14 a sectional illustration corresponding to FIG. 9, sectioned in the region of the transformer.

FIG. 14 shows a section in the region of one of the two transformers 240. The transformer 240 is arranged on an L-shaped base plate 242 in front of the running mechanism 1. In this arrangement the vertical limb 242*b* of the base plate 242 is clampingly secured in the front side groove 350. As can be recognised in FIG. 16 in plan view, two transformers 240 are arranged alongside one another on the base plate. By using two transformers, their constructional height is reduced. Alternatively, only a single transformer 240 can be used with special dimensions, for example with a slender overall shape through suitable winding.

Figure 15A:
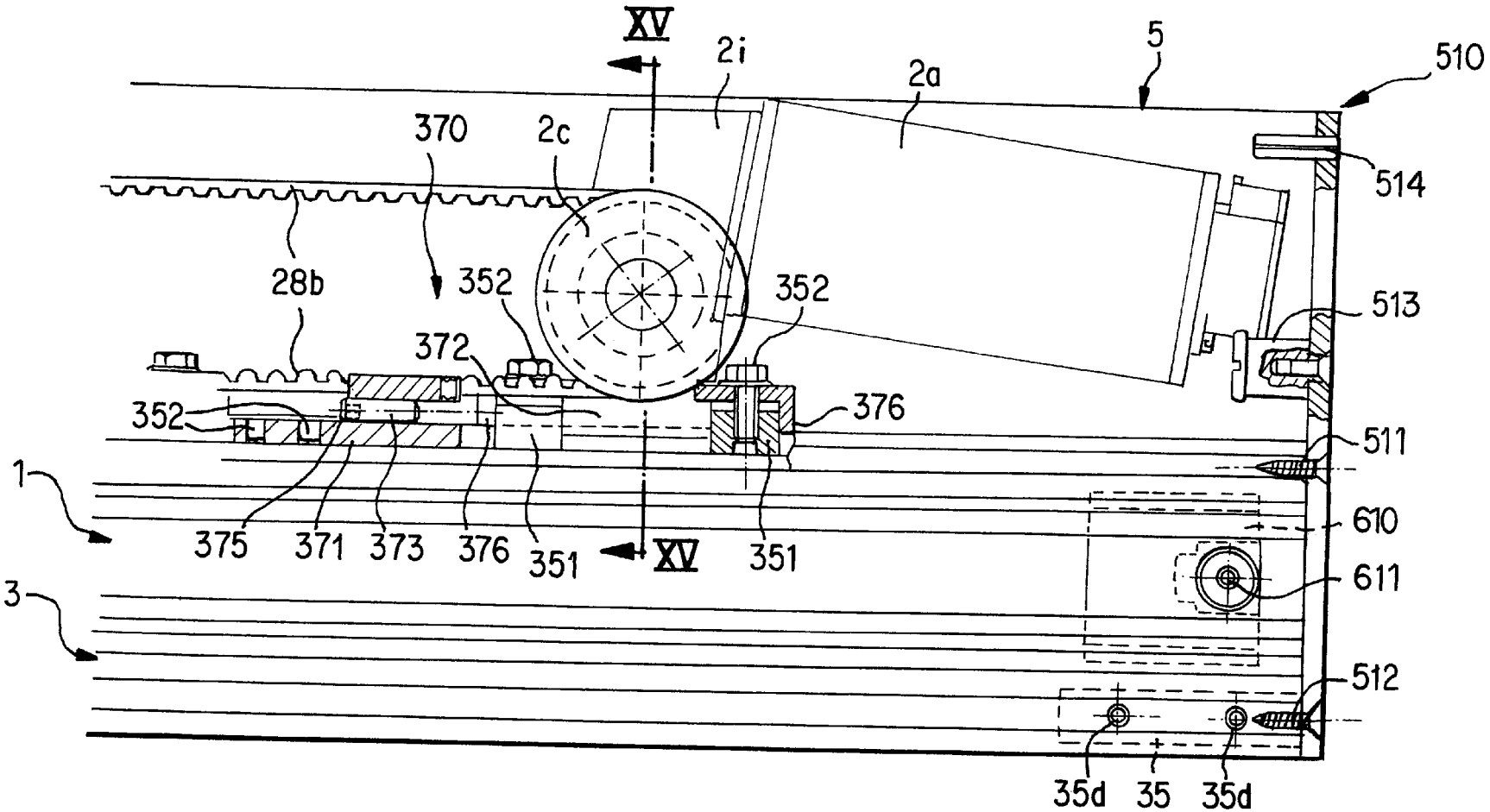
FIG. 15 a representation of the drive unit of the embodiment in FIG. 9, with motor and drive pulley in three views; (a): view from below, (b): front view, (C): sectional view along the line XV in 15*a;*
Figure 15B:
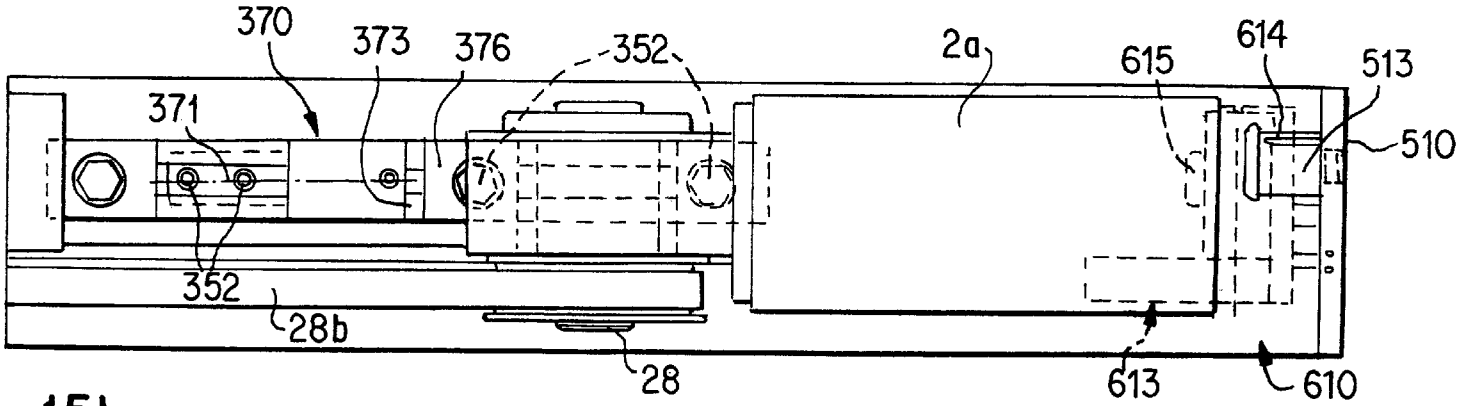
Figure 15C:
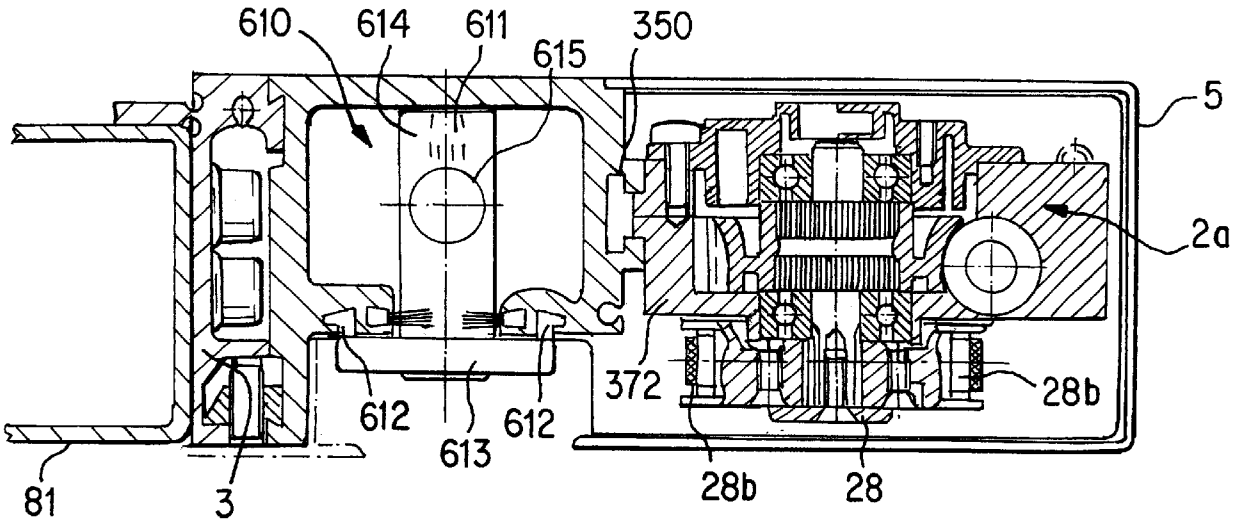

FIG. 15*a* shows a view from below onto the right hand end of the running mechanism 1 with the motor 2*a*, which is arranged there, with the transmission 2*i* and with the drive pulley 2*c* for the drive belt 28*b*, which is directly coupled to the transmission 2*i* of the motor 2*a*. Since the drive wheel 2*c* is directly mounted on the output drive shaft of the transmission 2*i*, a separate bearing block can be spared. The illustrated right hand side part 510, which covers over the running mechanism 1 and the carrier 3 from the side, is identically designed to the left hand side part 510 already described in FIG. 13. The motor 2*a* is of substantially bar-shaped design and is aligned in the longitudinal direction of the running mechanism 1, preferably at an acute angle to the longitudinal direction of the running mechanism. Including the drive pulley 2*c*, the motor 2*a* takes up the entire cross-section of the receiving space 55, as can be recognised from the plan view of FIG. 15*b*, and the sectional illustration of FIG. 15*c* along the line XV in FIG. 15*a*, i.e. the constructional space between the running mechanism 1 and the cover hood 5. The drive rail 2 is horizontally aligned and arranged beneath the motor 2*a*.

The drive unit with the motor 2*a* and the drive disc 2*c* is secured onto a clamping device 370, which enables a tensioning of the toothed belt 28*b*, by shifting the complete drive unit in the longitudinal direction of the running mechanism on the clamping device 370. The drive unit is clampingly secured in the front side groove 350 via the clamping device 370.

Figure 16:
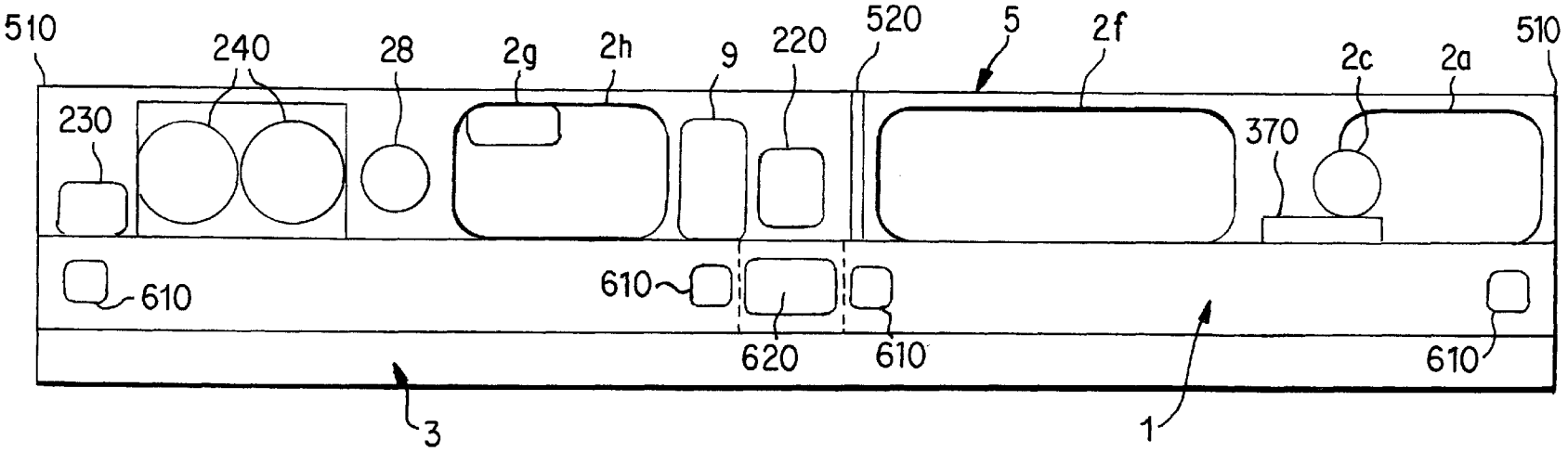
FIG. 16 a schematic, overall illustration of the embodiment in FIG. 9 in plan view.

FIG. 16 shows an overall view of the components of the sliding door system shown in FIGS. 9 to 15. From the left to the right there can be seen: left hand side part 510, socket 230, transformer 240, deflection roller 28, cable holder 2*h* with accumulator pack 2*g*, locking device 9, radar 220, holding yoke 520, control unit 2*f*, clamping device 370, drive pulley 2*c*, motor 2*a* and right hand side part 510. In the running mechanism 1 secured to the carrier 3 there can be seen four buffers 610 and the central cutout 620 for the insertion of the roller carriages 6.

In place of a continuous running mechanism section 63 with a central cutout 620, a splitting into two of the running mechanism section 63 at its axial centre is also possible as an alternative, i.e. that a left and right hand part section is separately present for the left hand and the right hand wing. The two part sections are separately secured to the carrier 3. In doing so, a cutout for the insertion of the roller carriage 6 likewise remains free at the centre, as is illustrated in broken lines in FIG. 16.

The placing of the individual components on the running mechanism 1 preferably takes place independently of the total width and width of opening of the drive.

Figure 17:
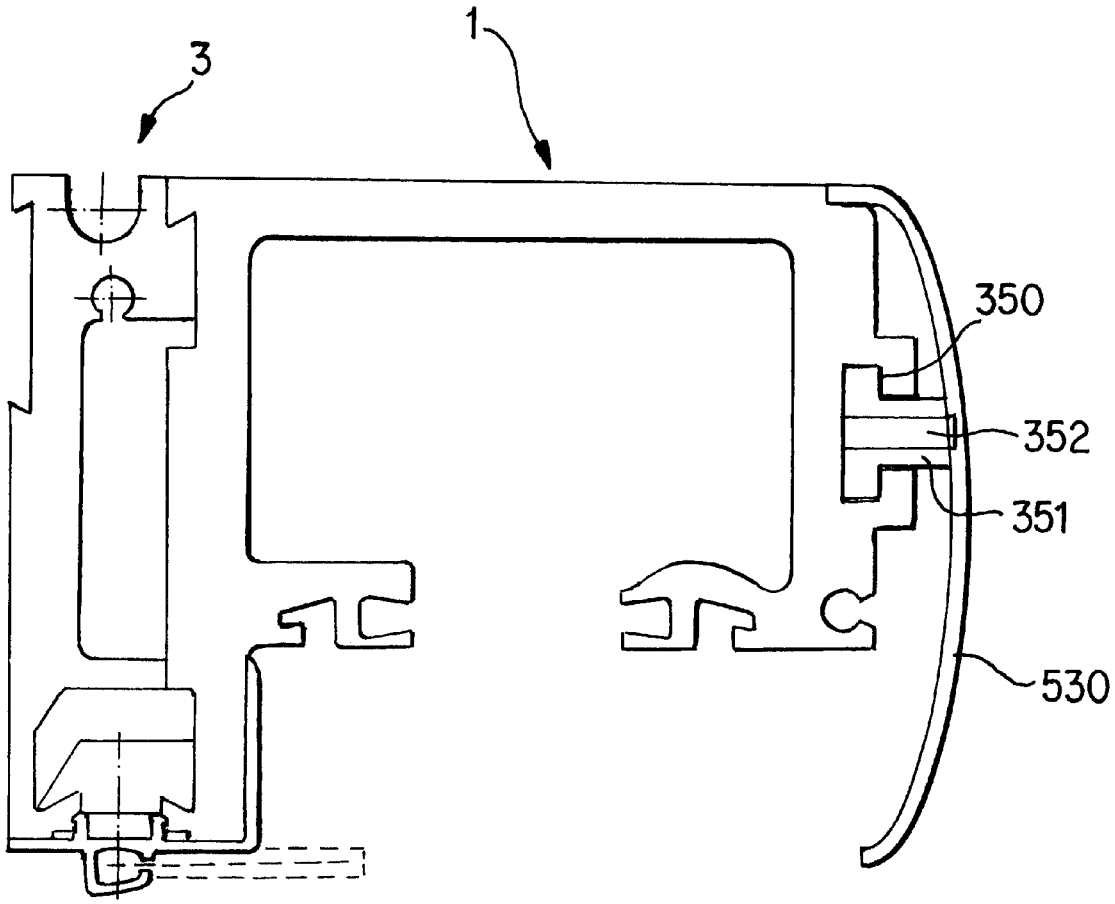
FIG. 17 a sectional illustration of a running mechanism module with a cover hood in manual sliding doors, without illustration of the roller carriage.

FIG. 17 shows a cover screen 530, with which the running mechanism 1 is hidden, provided no drive and control elements are to be installed, which is, for example, the case with manual sliding doors. The cover screen 530 has a convexely shaped front side and is secured in the front groove 350 of the running mechanism 1 by means of clamping blocks 351 and clamping bolts 352. In this arrangement the upper horizontal edge of the cover screen 530 finishes flush with the front upper horizontal edge of the running mechanism 1 and the lower horizontal edge of the cover screen 530 lies at the level of the lower edge of the vertical limb 63*a* of the running mechanism 1, so that the wing upper edge is covered over. The width of the cover screen 530 corresponds to the width of the running mechanism

LIST OF THE REFERENCE NUMERALS

1 running mechanism
1*a* running roller
1*b*, 1*b*' running surface
1*c* sectional housing limb
1*d* rotary thrust bearing
1*e* screw mounting
1*f* rail
10 wing
12 fixed field wing
13 dove-tail section
14, 15 dove-tail groove
21 U-shaped sectional body
22, 23 U-limbs
22*a*, 23*a* longitudinal grooves
24 transverse pin
31 receiving plate
36 running ball
37 running groove housing
38 bearing plate
39 running groove bearing plate
9 latching device
2 motor and control module
2*a* motor
2*b* deflection roller
2*c* drive pinion
2*d* rubber cord
2*e* electric cable
2*f* control unit
2*g* accumulator pack
2*h* cable channel/cable holder
2*i* transmission
25 driver yoke
25*a*, 25*b* end of yoke
25*c* counterpiece
25*d* adjustment device
25*e* bolted arrangement
25*f* screw mounting
26 bolted arrangement
27 sectional housing
27*a* vertical limb
27*b* horizontal limb
27*c* sliding guide
28 deflection roller
28*a* vertical axis of rotation
28*b* toothed belt
28*c* rotary bearing
29 clamped connection
220 radar
221 holding arm
222 housing
223 sensor
224 screw mounting
230 socket
231 screw mounting
232 base plate
233 mains plug
234 on/off switch
240 transformer
270 upper part of the housing
271 cover
272 insert groove
273 cooling body
3 carrier module
3*a* horizontal limb
3*b* vertical limb
3*c* cutout
32 point of intended breakage
33 in-hanging device
33*a* dove-tail groove
34 clamping device
34*a* mount
35 clamping piece
35*a* base surface
35*b* dove-tail section
35*c* wedge surface
35*d* clamping screw
35*e* strip
350 receiving groove

351 clamping block
352 clamping bolt
352*a* bolt head
353 threaded bore
354 groove bounding strips
370 clamping device
371 abutment
372 carriage
373 threaded pin
374 clamping screw
375 threaded bore
376 clamping claw
4 indication/communication module
5 cover hood
5*a* point of intended breakage
5*b* vertical limb
5*c* horizontal limb
51 groove
55 receiving space
510 side part
511, 512 bolt
513 holding head
514 pin
515 cutout
520 holding yoke
530 cover screen
6 roller carriage
6*a* upper chamber
6*h* horizontal limb
6*v* vertical limb
61 longitudinal grooves
62 longitudinal edges
63 U-section
63*a*, 63*b* vertical limb
63*c* support section
63*d* horizontal limb
64*a*, 64*b* central webs
65 receiving grooves
66 sealing brush
67 base body
67*a* cutout
68 axle
69 running roller
69*a, b* running roller
69*h, v* running roller
600 receiving grooves
610 buffer
611 bolted connection
620 cutout
630 support surface
7 suspension and adjusting device
7*a* lower chamber
71 hexagonal bolt
74 yoke
75 base plate
8 post/transom construction
81 transom
81*b, c* reinforcement section
82 suspended post
83 roof of storey
84 post
86 boundary post

What is claimed is:

1. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, and wherein said parallelepiped shaped body has a vertical height of between 60 mm and 70 mm.

2. An assembly according to claim 1, wherein said drive motor assembly includes an electric drive motor which drives a circulating drive belt guided over deflection rollers.

3. An assembly according to claim 2, wherein the drive motor has a transmission with a drive pulley for the circulating drive belt at the output drive side.

4. An assembly according to claim 1, wherein the drive motor assembly includes a drive belt driven by a drive motor and guided in a horizontal plane via deflection rollers, with a vertical axis of rotation.

5. An assembly according to claim 4, wherein a driver which in use connects the door wing to the drive belt extends in a horizontal plane from an upper edge of the door wing to the drive belt, with provision being made for the top edge of the door wing to lie at least approximately in the same horizontal plane as the drive belt.

6. An assembly according to claim 1, wherein the drive motor assembly includes a drive belt driven by a drive motor and arranged in a plane beneath other drive units of the drive motor assembly including a motor, a control, an accumulator pack, and a transformer.

7. An assembly according to claim 6, wherein a driver which in use connects the door wing to the drive belt extends in a horizontal plane from an upper edge of the door wing to the drive belt, with provision being made for the top edge of the door wing to lie at least approximately in the same horizontal plane as the drive belt.

8. An assembly according to claim 1, wherein the running mechanism housing is formed as a sectional housing, which has two parallel vertical limbs, of which the first limb is arranged in use adjoining the transom, or on a separate carrier and the second limb is arranged adjoining the drive motor assembly housing.

9. An assembly according to claim 8, wherein the second vertical limb is made substantially shorter than the first vertical limb.

10. An assembly according to claim 9, wherein the drive motor assembly includes a first running roller with a horizontal axis of rotation and a second running roller with a vertical axis of rotation.

11. An assembly according to claim 10, wherein the first running roller is guided in the region of the first vertical limb and the second running roller is guided in the region of the second vertical limb.

12. An assembly according to claim 11, wherein the second running roller is formed as a support roller, which is supported on the first or second vertical limb.

13. An assembly according to claim 10, wherein the second running roller is formed as a support roller, which is supported on the first or second vertical limb.

14. An assembly according to claim 10, with at least one roller carriage guided in the running mechanism housing and with a suspension device for the sliding door wing connected to the roller carriage, wherein the suspension device is formed as a suspension and adjusting device, and wherein the first running roller and the second running roller are mounted on one roller carriage body, which has a vertical limb and a horizontal limb.

15. An assembly according to claim 14, wherein the suspension and adjusting device is connected to the vertical limb of the roller carriage body, or with the horizontal limb of the roller carriage body.

16. An assembly according to claim 1, wherein the running mechanism is supported on a fixed field door wing when in an in use operating position.

17. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the support frame transom when in an in use operating position mounted on the support frame, and wherein a display and communications module housing is connected to said drive motor assembly housing at a side facing away from the support frame transom when in an in use operating position mounted on the support frame.

18. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, wherein the running mechanism housing is formed with a substantially square cross-section, and wherein the drive motor assembly housing includes a receiving space for the drive and control devices and has substantially the same sized cross-section as the running mechanism housing.

19. An assembly according to claim 18, wherein the receiving space is surrounded by a cover hood, the lower edge of which cover hood is parallel with an upper edge of the running mechanism housing and lies in use beneath an upper edge of the door wing.

20. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to the transom and the door wing when in an in use operating position mounted on the support frame, wherein the running mechanism housing and drive motor assembly housing form a substantially parallelepiped shaped body with a lower edge extending along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, and wherein the running mechanism housing and the receiving space have the same axial length and extend over an entire door width.

21. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to the transom and the door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, and wherein the running mechanism housing is connectable in use to said transom by way of a separate carrier housing, said carrier housing having a horizontal limb and a vertical limb, with the horizontal limb lying in use on the transom and the lower edge of the vertical limb terminating with the lower edge of the transom.

22. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to the transom and the door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, wherein the running mechanism housing is connectable to said transom by way of a separate carrier housing, and wherein the carrier housing is formed in use as a part of the transom.

23. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to the transom and the door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, and wherein the running mechanism housing has a mounting means for the mounting of modules arranged lying behind one another when seen from the front side of the sliding door wing.

24. A sliding door system according to claim 23, wherein the mounting means has a hook-in device and a clamping device and wherein the hook-in device is arranged at an upper horizontal edge of the running mechanism housing, and the clamping device is arranged at a lower horizontal edge or vice versa.

25. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, and wherein a mounting means is formed at the running mechanism housing in such a way that drive and control devices can be fixed into it with variable placing, individually or in component groups.

26. An assembly according to claim 25, wherein the mounting means is a horizontally extending C-groove.

27. An assembly according to claim 26, wherein the groove is formed as a one-piece element of the running mechanism housing.

28. An assembly according to claim 26, wherein the groove is formed at a front side at a half height of the running mechanism housing.

29. An assembly according to claim 26, wherein the drive and control devices are secured in the groove via clamping blocks with clamping bolts.

30. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use along an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, wherein the drive motor assembly includes a drive belt driven by a drive motor and guided in a horizontal plane via deflection rollers, with a vertical axis of rotation, wherein a driver which in use connects the door wing to the drive belt extends in a horizontal plane from an upper edge of the door wing to the drive belt, with provision being made for a top edge of the door wing to lie at least approximately in the same horizontal plane as the drive belt, and wherein the running mechanism housing includes two vertical limbs, wherein one of the two vertical limbs is of shortened design for the passage of the driver.

31. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and the door wing, wherein said running mechanism housing and said drive motor assembly housing are disposed adjacent to and behind one another in a direction transverse to a support frame transom and the door wing when in an in use operating position mounted on a support frame, wherein the running mechanism housing and drive motor assembly housing form a substantially parallelepiped shaped body with a lower edge extending in use a long an upper edge of the door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, wherein at least one roller carriage is guided in the running mechanism housing and a suspension device for the sliding door wing is connected to the roller carriage, with the suspension device being designed as a suspension and adjustment device, wherein the running mechanism has a web on at least one vertical limb which divides the running mechanism housing into an upper region and a lower region, wherein the roller carriage is arranged in an upper region and a web is formed as a guide means for the roller carriage, and wherein the sliding door wing engages in use, at least in a region of its upper edge, into a lower region of the running mechanism housing.

32. An assembly according to claim 31, wherein both vertical limbs of the running mechanism housing each have a web, with both webs lying in a common horizontal plane.

33. An assembly according to claim 31, wherein the axes of rotation of the running rollers of the roller carriage are arranged horizontally, vertically or angled to the horizontal.

34. An assembly according to claim 33, wherein the axis of rotation carries at least two differently shaped running rollers.

35. An assembly according to claim 34, wherein one of the running rollers has a running surface with a convex or concave cross-section, and one of the running rollers has a planar running surface, and the running surfaces of the webs each have a shape complementary thereto.

36. An assembly according to claim 34, wherein one of the running rollers has cutout extending around it in the running surface, with a draw element in the form of one of a resilient draw member, and rubber cord being guided in the cutout.

37. An assembly comprising:

a running mechanism disposed in a running mechanism housing and operable to carry at least one sliding door wing during movements thereof, and a drive motor assembly disposed in a drive motor assembly housing and operably connected to the running mechanism to drivingly move the running mechanism and the at least one door wing, wherein said running mechanism housing and said drive motor assembly housing are disposed adjacent to and behind one another in a direction transverse to a support frame transom and the at least one door wing when in an in use operating position mounted on a support frame, wherein the running mechanism housing and drive motor assembly housing form a substantially parallelepiped shaped body with a lower edge extending in use along an upper edge of the at least one door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, wherein the running mechanism housing is of a design divided into two parts in its axial extent with the at least one door wing including respective first and second door wings, with the first door wing being guided in use with roller carriages in a first part of the running mechanism housing and the second door wing being guided in use with roller carriages in a second part of the running mechanism housing, and wherein provision is made for a cutout to remain between the first part and the second part for the insertion of the roller carriages.

38. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and door wing, wherein said running mechanism housing and said drive motor assembly housing are disposed adjacent to and behind one another in a direction transverse to the transom and door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, and wherein said parallelepiped shaped body has a vertical height of between 60 mm and 70 mm.

39. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and door wing, wherein said running mechanism housing and said drive motor assembly housing are disposed adjacent to and behind one another in a direction transverse to the transom and door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, and wherein a display and communications module housing is connected to said drive motor assembly housing at a side facing away from the transom.

40. A sliding door system including:

a support frame including vertical posts and a horizontal transom, a sliding door wing, and an assembly for supporting the sliding door wing at the support frame, said assembly comprising:

a running mechanism disposed in a running mechanism housing and operable to carry the door wing during movements thereof, and a drive motor assembly disposed in a drive motor assembly housing and operably connected to the running mechanism to drivingly move the running mechanism and door wing, wherein said running mechanism housing and said drive motor assembly housing are disposed adjacent to and behind one another in a direction transverse to the transom and door wing when in an in use operating position mounted on the support frame, wherein the running mechanism housing and drive motor assembly housing form a substantially parallelepiped shaped body with a lower edge extending along an upper edge of the wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of the transom, and wherein the running mechanism housing is connectable to said transom by way of a separate carrier housing, said carrier housing having a horizontal limb and a vertical limb, with the horizontal limb lying in use on the transom and the lower edge of the vertical limb terminating with the lower edge of the transom.

41. An assembly comprising:

a running mechanism disposed in a running mechanism housing and operable to carry a sliding door wing during movements thereof, and a drive motor assembly disposed in a drive motor assembly housing and operably connected to the running mechanism to drivingly move the running mechanism and door wing, wherein said running mechanism housing and said drive motor assembly housing are disposed adjacent to and behind one another in a direction transverse to a support frame transom and door wing when in an in use operating position mounted on a support frame, wherein the running mechanism housing and drive motor assembly housing form a substantially parallelepiped shaped body with a lower edge extending in use along an upper edge of a door wing, said parallelepiped shaped body having a vertical height determined by a vertical cross-section of the respective running mechanism housing and drive motor assembly housing, wherein the parallelepiped shaped body has a horizontal width which is at least twice as large as its vertical height, said vertical height corresponding approximately to a vertical height of a support frame transom when in an in use operating position mounted on a support frame, wherein at least one roller carriage is guided in the running mechanism housing and a suspension device for the sliding door wing is connected to the roller carriage, with the suspension device being designed as a suspension and adjustment device, wherein the running mechanism has a web on at least one vertical limb which divides the running mechanism housing into an upper region and a lower region, wherein the roller carriage is arranged in an upper region and a web is formed as a guide means for the roller carriage, and wherein the suspension device engages at least with its substantially vertical extent into a lower region of the running mechanism housing.

* * * * *